US006129356A

United States Patent [19]

Li

[11] Patent Number: 6,129,356

[45] Date of Patent: Oct. 10, 2000

[54] FIVE-LAYER INTELLECTUAL CUBE

[76] Inventor: Chen Sen Li, No. 25, Lane 169, Cheng-Ho Rd., Been-Shang Village, San-Min Area, Kaohsiung City, Taiwan

[21] Appl. No.: 09/075,786

[22] Filed: May 12, 1998

[51] Int. Cl.[7] ..... A63F 9/08

[52] U.S. Cl. ..... 273/153 S

[58] Field of Search ..... 273/153 R, 157 R, 273/153 S

[56] References Cited

U.S. PATENT DOCUMENTS

| | | | |
|---|---|---|---|
| 5,271,688 | 12/1993 | Chang | 273/153 S |
| 5,826,871 | 10/1998 | Li | 273/153 S |

FOREIGN PATENT DOCUMENTS

| | | | |
|---|---|---|---|
| 3125817 | 1/1983 | Germany | 273/153 S |
| 1258457 | 9/1986 | U.S.S.R. | 273/153 S |
| 1733028 | 5/1992 | U.S.S.R. | 273/153 S |
| 2111840 | 7/1983 | United Kingdom | 273/153 S |
| 2113104 | 8/1983 | United Kingdom | 273/153 S |

*Primary Examiner*—Steven Wong
*Attorney, Agent, or Firm*—Bacon & Thomas

[57] ABSTRACT

A five-layer intellectual cube includes six sides, each of which is divided vertically and horizontally into five smaller movable surfaces respectively so that each side has 25 smaller movable surfaces. By rotating the six sides, the arrangement of the smaller movable surfaces can be changed to provide a variety of combinations by colors or patterns. The cube includes a central axle block, six first blocks, twenty-four second blocks, twelve third blocks, twenty-four fourth blocks, twenty-four fifth blocks and eight sixth blocks arranged so that the blocks can be assembled into regular sub-units that can easily be stacked to form the cube.

2 Claims, 24 Drawing Sheets

FIVE-LAYER INTELLECTUAL CUBE

BACKGROUND OF THE INVENTION

1. Field of the Invention

The present invention is related to a five-layer intellectual cube. The five-layer intellectual cube is a square cube comprising six sides having twenty-five smaller movable square-shaped blocks arranged horizontally and vertically and is provided with various colors or patterns. These square-shaped blocks can be rotated to change their orientations, so that each side of the square cube can be varied in combination by colors or patterns, and this can arouse the brains of people to get an intellectually enhancing effect and increase complexity of the intellectual square cube.

2. Description of the Prior Art

Human brains and intellect continuously grow together with age. However, brains are subjected to dullness when they lack training. Therefore, there are a lot of intellectual toys or games in the market for players to arouse their brains during playing, so that their brains can be strengthened in company with continuous thinking.

Among the early intellectual toys or games, the widely prevailing three-layer intellectual cube (or so called magic cube) is a square cube having six sides each composed of nine (3×3) movable square-shaped surfaces and has three layers both in vertical and in horizontal directions. Normally each of the six sides of the square cube are applied with a different color, i.e., the nine square-shaped movable surfaces on each side are of one color. When any layer is rotated to change its position, the smaller movable surfaces of each side in this layer are moved respectively to another side of different color. Therefore these sides have miscellaneous colors, i.e. the six sides all change. The way to play to mix up the colors of the six sides of the square cube, and then to rotate all the layers to move every group of smaller movable surfaces having the same color to their proper side, until all the six sides of the square cube recover their own singular colors.

The above stated conventional three-layer intellectual cube has its proper area and depth of thinking due to the playing method of its game. It provides an important way of organization, thought and judgement, yet it is not overly complicated, and thereby has been very popular. However, while the conventional three-layer intellectual cube has been around for a very long time and is well known, it is no longer so popular, the number of people playing it having gradually diminished.

SUMMARY OF THE INVENTION

Because the intellectual cube can help arouse brains, stimulate imagination and judgement, and help the growing of brains, the inventor of the present invention has developed, after much study and improving, a five-layer intellectual cube of which each side is more variable in combination, so that the game thereof can be enlarged in the area of thinking during playing, and thus the benefit of arousing of brains can be obtained.

In particular, the five-layer intellectual cube of the present invention is a square cube having six sides divided vertically and horizontally into twenty-five smaller movable surfaces; by rotating these smaller movable surfaces to change their orientation, every side will have various possibilities for combination of colors and patterns, arousing the brains of people to get an intellectual enhancing effect. The structure includes a central axle block, 6 first blocks, 24 second blocks, 12 third blocks, 24 fourth blocks, 24 fifth blocks and 8 sixth blocks, wherein:

The central axle block is placed at the center of the five-layer intellectual cube, and six axle rods are perpendicularly provided respectively on the six sides of the five-layer intellectual cube.

The first blocks are generally in "T" shapes, the tops thereof facing outwardly are provided each with a smaller movable surface. A rotation axle provided on the bottom of each first block is pivotally mounted in one of the tailing ends of the six axle rods and can be rotated thereon. The first blocks are thereby exactly located at the center positions of the six sides respectively.

The second blocks are provided on the tops thereof each with a square-shaped movable surface, and are positioned respectively on the four sides of the first blocks, the inner sides thereof are provided each with a second engaging block.

The third blocks each have a top and a lateral surface perpendicular to each other. These surfaces each form a smaller movable surface. The third blocks are positioned at the outer edges of the tops of the second blocks. The two square-shaped movable surfaces on each third block are located exactly at a comer where two sides of the fivelayer intellectual cube orthogonally interconnect to each other; and the inner sides thereof are provided each with a third engaging block.

The fourth blocks are provided on the tops thereof each with a smaller or square-shaped movable surface. The inner sides thereof are provided each with a fourth engaging block. These square-shaped movable surfaces are positioned at the four corners of the first blocks. That is, the two inner edges of each of these smaller square-shaped surfaces neighbor with the edges of the two second blocks which are on the same side of the intellectual cube as that of the smaller, movable surfaces of the fourth blocks and which are perpendicular to each other. The fourth blocks and the second blocks surround the 6 first blocks respectively.

The fifth blocks each have a top and a lateral surface perpendicular to each other. These surfaces each form a smaller or square-shaped movable surface. The fifth blocks are positioned at the two lateral sides of the third blocks, These two smaller movable surfaces are also located exactly at a corner where two sides of the five-layer intellectual cube orthogonally interconnect to each other. The lower inner portions thereof are provided each with a fifth engaging block.

The sixth blocks each have three smaller or square-shaped movable surfaces perpendicular to one another, and are positioned on the eight corners respectively of the intellectual cube. The inner sides thereof are provided each with a sixth engaging block.

Because of the mutual restraint and limitation of the above stated neighboring blocks, the blocks and the surficial smaller or square-shaped movable surfaces thereof can make rotational displacement to change their positions. The six sides of the five-layer intellectual cube can have a variety of combinations of colors or patterns on these smaller or square-shaped movable surfaces. The complexity of the intellectual square cube thereby can be increased, and an intellectual enhancing effect can be obtained.

The present invention will be apparent in its structure after reading the detailed description of the preferred embodiments thereof in reference to the accompanying drawings.

DETAILED DESCRIPTION OF THE PREFERRED EMBODIMENT

Figure 1:
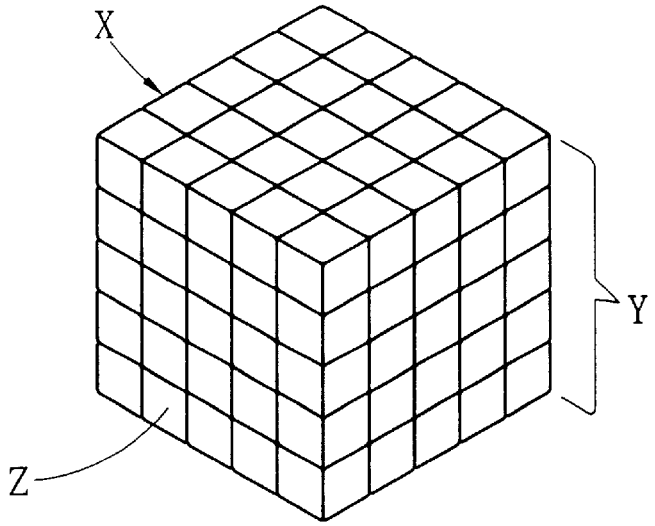
FIG. 1 is a perspective view showing the appearance of the present invention.

Referring to FIG. 1, the five-layer intellectual square cube X of the present invention has six sides Y of which each is divided vertically and horizontally into twenty-five (5×5) smaller movable surfaces.

Figure 2:
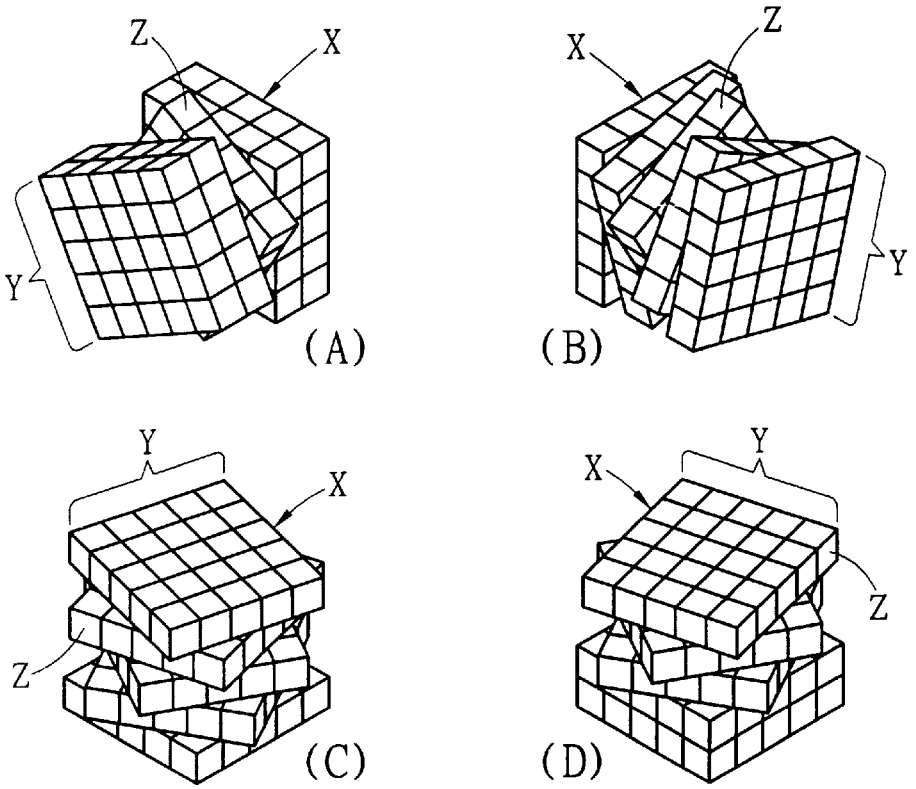
FIGS. 2(A), (B), (C) and (D) are schematic views showing the present invention in use.

As shown in FIGS. 2 (A), (B), (C) and (D), each layer of the five-layer intellectual square cube X can be rotated and displaced relatively. The movable side Z of this layer can be moved to another side Y, so that the six sides Y can have various combinations by providing different colors and patterns. Thereby, an intellectual enhancing effect can be obtained.

Figure 3:
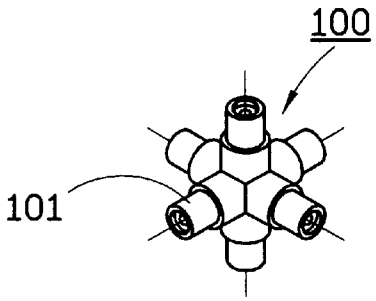
FIG. 3 is a perspective view of a central axle block of the present invention.

As are shown in FIGS. 3–22, the five-layer intellectual square cube X of the present invention includes a central axle block 100, six first blocks 10, twenty-four second blocks 20, twelve third blocks 30, twenty-four fourth blocks 40, twenty-four fifth blocks 50 and eight sixth blocks 60. Wherein, the structure assembled with the aforesaid members will be described in detail in reference to the accompanying drawings:

In the structure of the central axle block 100 as shown in FIG. 3, the central axle block 100 is located at the center of the five-layer intellectual square cube X, and six axle rods 101 are provided thereon and are respectively perpendicular to the six sides of the five-layer intellectual square cube X.

Figure 4:
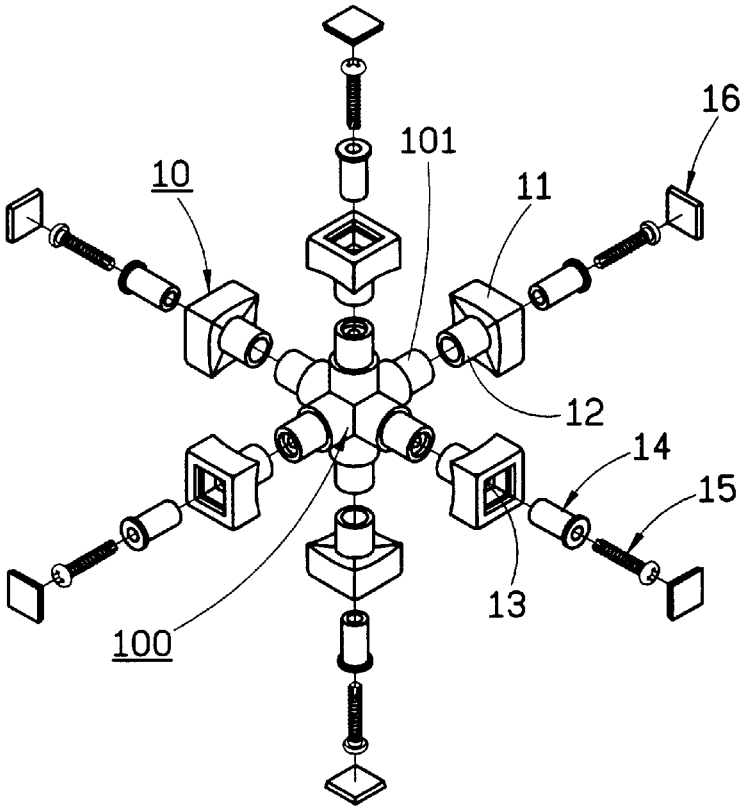
FIG. 4 is a schematic view showing assembling of the first blocks with the central axle block of the present invention.
Figure 5:
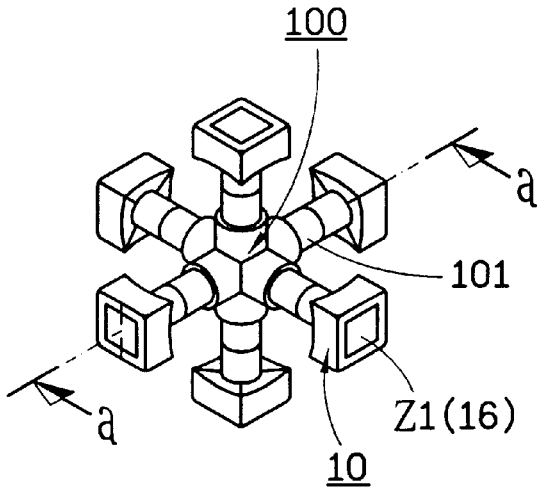
FIG. 5 is a perspective view showing the situation after assembling of the first blocks with the central axle block of the present invention.
Figure 6:
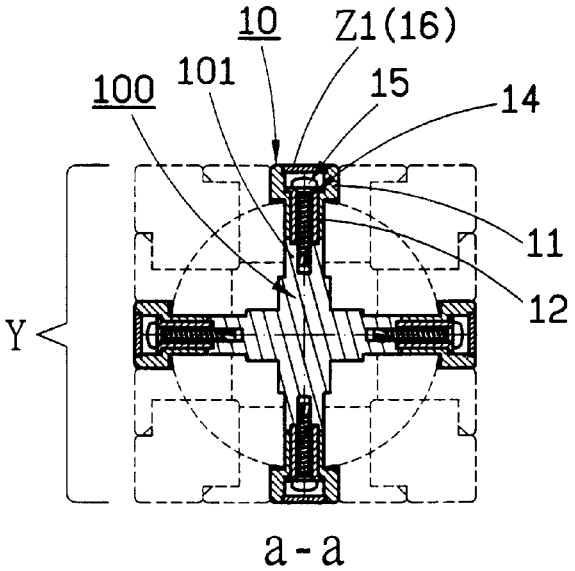
FIG. 6 is a sectional view taken from the sectional line a—a in FIG. 5, it shows the position of the central axle block and the first blocks.

Referring to the assembled structure of the first blocks 10 and the central axle block 100 as shown in FIGS. 4 to 6, the first blocks 10 are hollow and are generally in "IT" shapes. The tops thereof face outwardly and form rotatable plates 11, and a rotation axle 12 is provided on the bottom of each of them. The bottom surfaces of the rotatable plates 11 are all arciform, and the rotation axles 12 can be pivotally inserted respectively into the six axle rods 101 of the central axle block loo. When in practicing, a through hole 13 is drilled from the center of each rotatable plate 11 to the bottom end of the rotation axle 12 thereof. A sleeve 14 is provided in the through hole 13 when the bottom end of the sleeve 14 is aligned with an axle rod 101 of the central axle block 100, and one of the first blocks 10 is limited as to its position to the axle rod 101 and is rotatable about the axle rod 101. Lastly, a lid 16 is placed on the top of the rotatable plate 11 of which the top surface is a neat plane, so that the to surfaces of the first blocks 10 each forms a square-shaped movable surface Zi which is exactly positioned at the center of the side Y of the six sides Y.

Figure 7:
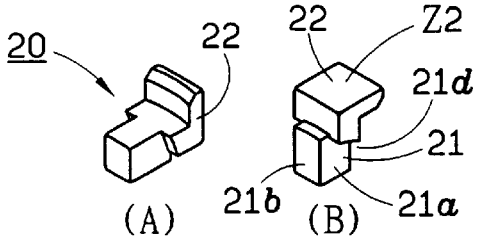
FIGS. 7(A) and (B) are perspective views showing the different angular positions of two second blocks.
Figure 8:
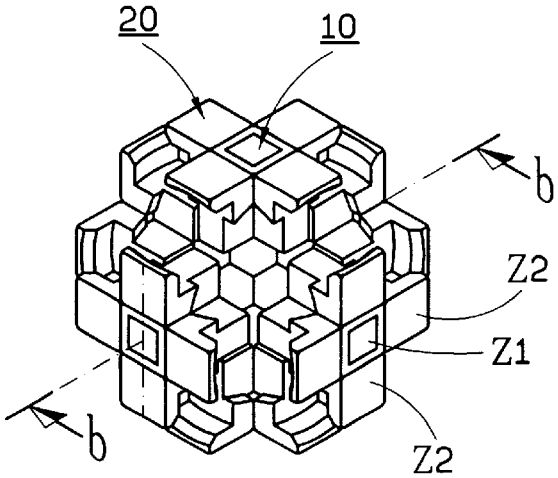
FIG. 8 is a perspective view showing the positions of a plurality of second blocks after assembling in the five-layer intellectual cube of the present invention.
Figure 9:
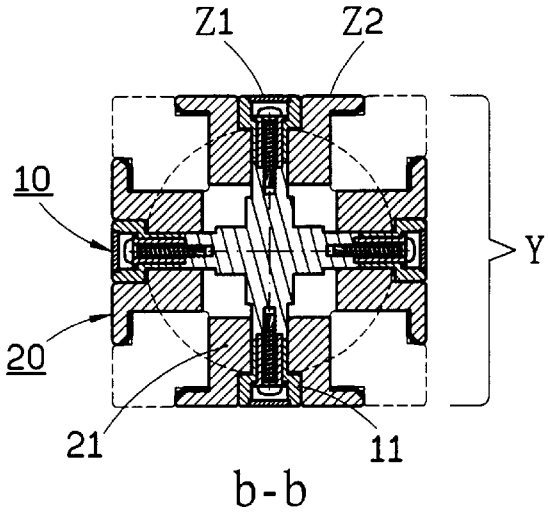
FIG. 9 is a sectional view taken from the sectional line b—b in FIG. 8.

Referring to the structure of the second blocks 20 shown in FIGS. 7 to 9, the side views of the second blocks 20 are each in an "L" shape. The rear sides of the tops abut respectively the four edges of the rotatable plates 11 of the first blocks 10. The front edges of the tops of the second blocks 20 protrude and are provided each with an arciform bottom surface. The top surfaces thereof each form a square-shaped movable surface Z2 and arc located respectively at all the four edges of the square-shaped movable surfaces ZI of the rotatable plates 11. The second blocks 20 are provided on the lower rear side thereof, each with a second engaging portion 21 as shown in FIG. 7(B), the back end of the second engaging portion 21 protrudes rearwardly to extend to the lower portion of one side of a rotatable plate 11. The protruding portion 21 has an arciform top ledge which is in conformity in shape with and abuts against the arciform bottom surface of the rotatable plate 11, so that the corresponding second block 20 will not drop. The width of the back of the second engaging portion 21 is smaller than that of the upper portion of the second block 20, so that the two lateral sides of the second block 20 protrude laterally, and the bottoms of the protruding portions are arciform surfaces. The second block 20 and second engaging portion 21 are both hollow, and the second engaging portion 21 has four sides 21 *a–d* of equal length and width, adjacent to an upper portion 22 of the second block 20.

Figure 10:
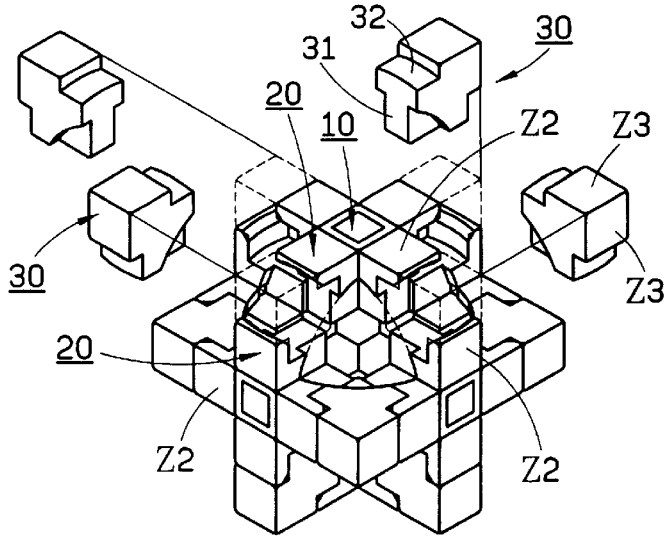
FIG. 10 is a perspective view showing the positions of the third blocks of the present invention.
Figure 11:
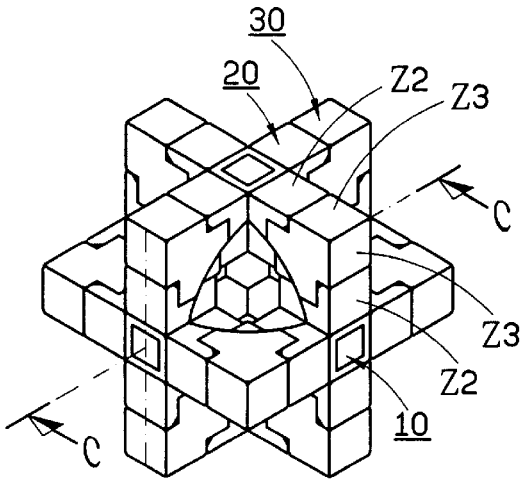
FIG. 11 is a perspective view showing the positions of the third blocks after they are assembled in the five-layer intellectual cube of the present invention.
Figure 12:
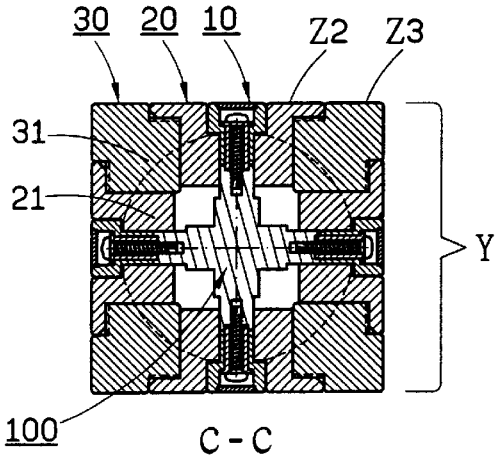
FIG. 12 is a sectional view taken from the sectional line c—c in FIG. 11.

Referring to FIGS. 10 to 12 showing the structure of the third blocks 30 and their positions on the intellectual square cube X, the third blocks 30 are disposed each between two second blocks 20, which are provided respectively on two neighboring sides Y. A top and a lateral surface thereof are perpendicular to each other and each forms a square-shaped movable surface Z3. The intersection of the two square-shaped movable surfaces Z3 (the outer edge) is located exactly at a corner where the stated two sides Y orthogonally interconnect to each other. The inner side of the third block 30 abuts the outer side of the square-shaped movable surface Z2 of a second block 20, so that the two square-shaped movable surfaces Z3 of third block 30 abut respectively the square-shaped movable surfaces Z2 of two second blocks 20 that are provided on the above mentioned two neighboring sides Y. The third block 30 is provided at its rear a third engaging portion 31. The top of the third engaging portion 31 is arciform for inserting the bottoms of the protruding portions to the tops of the two aforesaid second blocks 20, and it is limited by the protruding portions 21 of the second blocks 20 against dropping; the width of the bottom end of the third engaging portion 31 is smaller than that of the smaller movable surface Z3 and hence a "T" shape is formed between control axle block 100 and neighboring side Y. The bottom surfaces of the lateral ends of the top of the third engaging portion 31 are arciform and can be conformed with the bottom arciform surfaces of the lateral sides of the second block 20; the width of the bottom end of the third engaging portion 31 is equal t that of the second engaging portion 21. The third block 30 and third engaging portion 31 are both hollow. The third engaging portion 31 needs only one upper arciform shaped surface 32 to engage successfully with the second engaging portion 21 of the second block 20.

As shown in the drawings, the central axle block 10 allows the six first blocks 10 to be assembled and located to direct to the six orientations respectively on the five-layer intellectual square cube. The four edges of each first block 10 abut each with a second block 20 and a third block 30 abuts two second blocks 20 which are provided on two neighboring sides Y, i.e., two first blocks 10 on two neighboring sides Y contain therebetween two second blocks 20 and a third block 30. Taking the first block 10 on the top of the drawings as an example, each edge of the first block 10 neighbors in turn with a second block 20, and a third block 30 abuts second blocks 20 on the neighboring side Y. The edge of another second block 20 in turn abuts another first block 10 on a neighboring side Y. In other words, the first block 10 on the top of the drawings forms a center, and there are four second blocks 20 and four third blocks 30 arranged sequentially on the four edges thereof. The four third blocks 30 then abut four second blocks 20 on four neighboring sides Y, and the other edges of the four second blocks 20 in turn abut other four first blocks 10 on the four neighboring sides Y. Although the first blocks 10, the second blocks 20, and the third blocks 30 are mutually limited not to drop, however, each block can be moved sidewardly. When taking the first block 10 on the top as a center, the second blocks 20 and third blocks 30 therearound (and the other four first blocks 10 on the four neighboring sides Y) can be rotated thereabout to change positions optionally. If another first block 10 on another side Y is taken as a center, the situation is the same, in fact, each first block 10 is taken as a center, and the modes of rotation of the five-layer intellectual cube X of the present invention as shown in FIGS. 2(A), (B), (C) and (D) thus are obtained.

Figure 13:
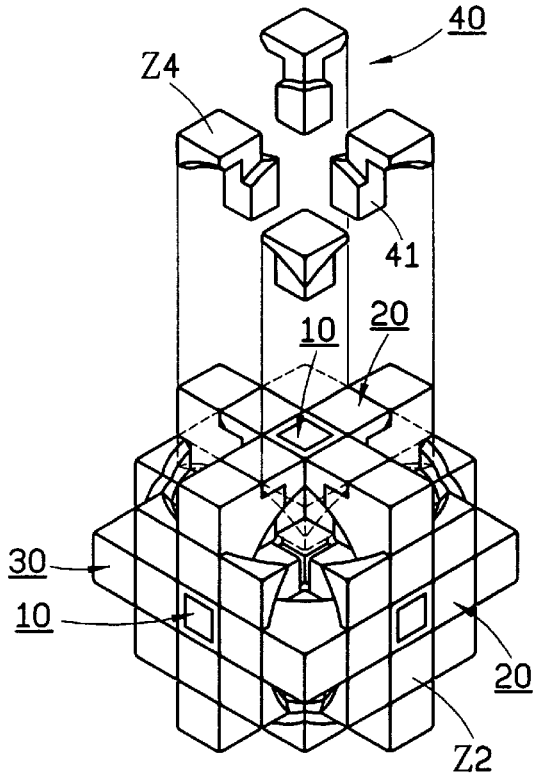
FIG. 13 is a perspective view showing the positions of the fourth blocks of the present invention.
Figure 14:
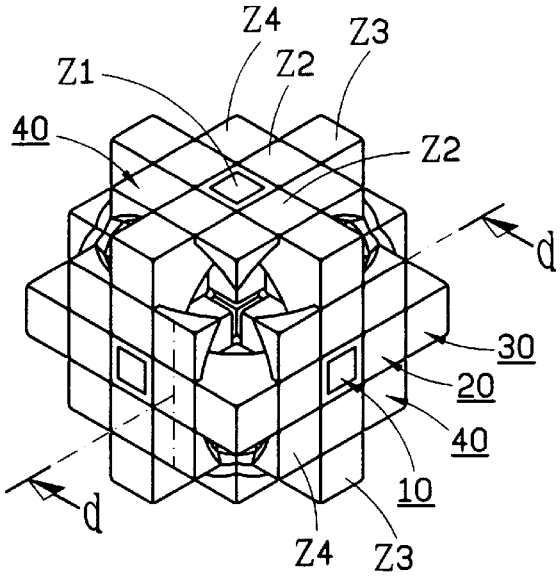
FIG. 14 is a perspective view showing the positions of the fourth blocks after they are assembled in the five-layer intellectual cube of the present invention.
Figure 15:
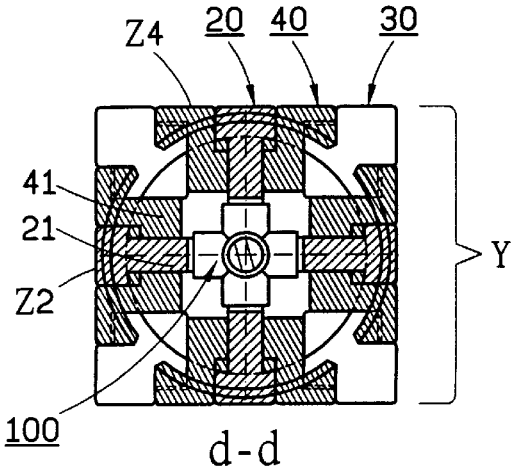
FIG. 15 is a sectional view taken from the sectional line d—d in FIG. 14.
Figure 16:
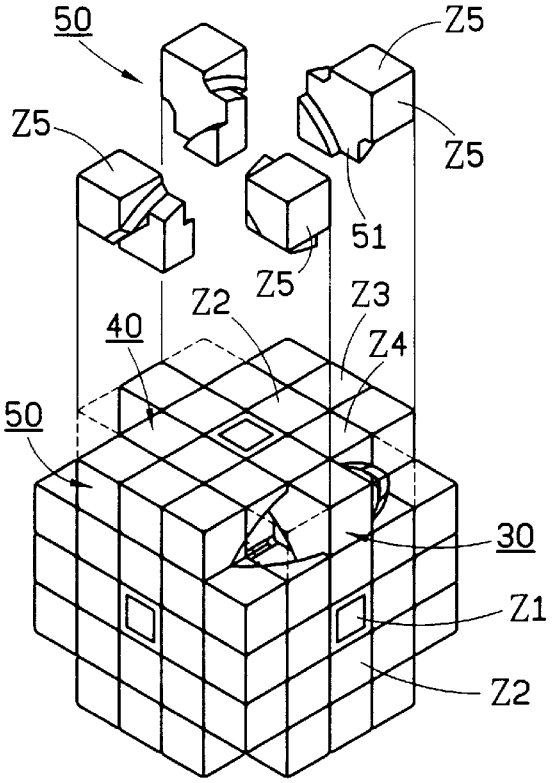
FIG. 16 is a perspective view showing the positions of the fifth blocks of the present invention.
Figure 17:
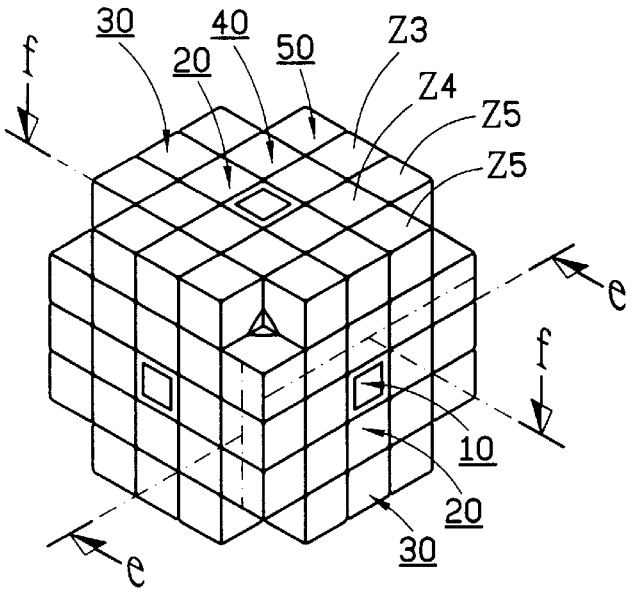
FIG. 17 is a perspective view showing the positions of the fifth blocks after they are assembled in the five -layer intellectual cube of the present invention.
Figure 18:
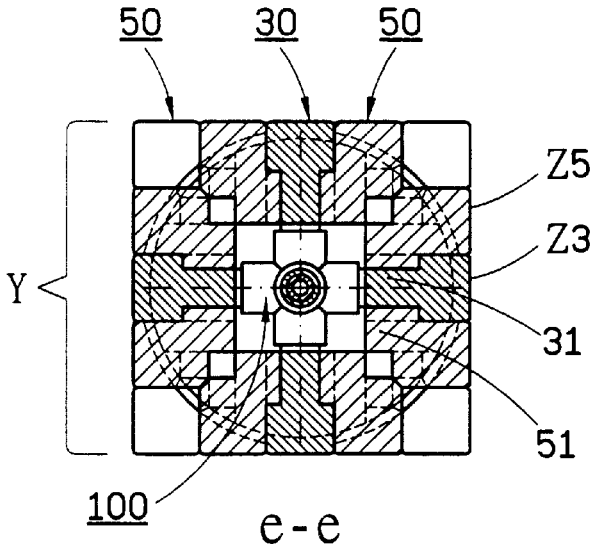
FIG. 18 is a sectional view taken from the sectional line e—e in FIG. 17.
Figure 19:
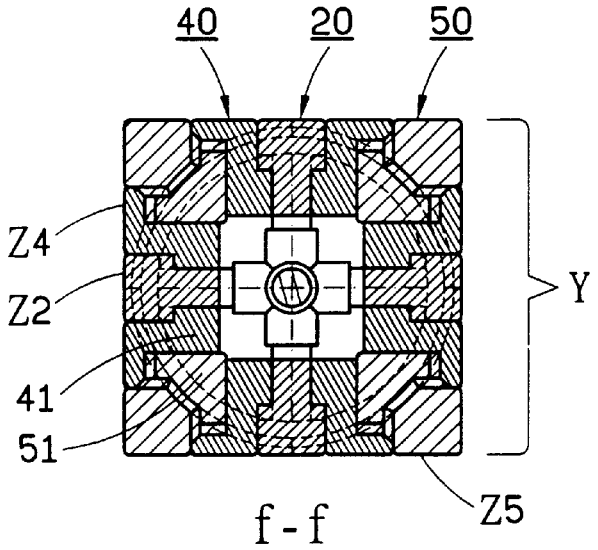
FIG. 19 is a sectional view taken from the sectional line f—f in FIG. 17.

Referring to FIGS. 13 to 15 showing the structure of the fourth blocks 40 and their positions on the intellectual square cube X. The fourth blocks 40 are hollow and are provided on the tops thereof each with a smaller or square-shaped movable surface Z4. All the smaller movable surfaces Z4 are positioned at the four corners respectively of all the first blocks 10. That is, the two inner edges of each of these smaller movable surfaces Z4 neighbor with the edges of the smaller movable surfaces Z2 of the two second blocks 20 which are on the same side Y of the intellectual cube as that of the smaller movable surfaces Z4, and which are perpendicular to each other. The fourth blocks 40 and the second blocks 20 surround the six first blocks, and can be moved together with the second blocks 20 neighboring therewith; further, the fourth blocks 40 are generally in the shape of a "Z", the bottom of each smaller or square-shaped movable surface Z4 therefore bends and is arciform. The inner sides of the fourth blocks 40 thereof are provided each with a fourth engaging portion 41. The fourth block 40 protrudes toward the rotation axle 12 of a first block 10 (referring to FIG. 6) and the second engaging portion 21 of the above stated two second blocks 20 are perpendicular to each other. The top surface Z4 of the protruding portion 41 of the fourth block 40 is arciform and abuts on the bottom arciform surfaces respectively of the smaller movable surfaces Z1, Z2 of the first block 10 and its corresponding second block 20, so that the fourth block 40 is limited not to drop.

Referring to FIGS. 16 to 19 showing the structure of the fifth blocks 50 and their positions on the intellectual square cube X. The fifth blocks 50 are hollow and are provided at the two lateral sides of the third blocks 30, the top on one side Y and the lateral surface thereof on another side Y are perpendicular to each other to form each a smaller or square-shaped movable surface Z5 just like the case on the third blocks 30. The intersection of the two smaller movable surfaces Z5 (the outer edge) is also located exactly at a corner where the two sides Y orthogonally interconnect to each other, the inner side of a fifth block 50 abuts an outer side of the smaller or square-shaped movable surface Z4 of a fourth block 40; by the fact that the two inner sides of the smaller movable surface Z4 of a fourth block 40 neighbor respectively with two smaller movable surfaces Z2 of two second blocks 20 which are perpendicular to each other, so that the two outer sides thereof are perpendicular to each other too, and abut respectively on the inner sides of two smaller movable surfaces Z5 of two fifth blocks 50. The facing directions of these two small -er movable surfaces Z5 of the two fifth blocks 50 are also perpendicular to each other; the lower portions of the fifth blocks 50 are provided each with two lateral ledges of which the tops are arciform and abut against the bottom arciform surfaces of the two smaller movable surfaces Z4 of two fourth blocks 40. The fifth blocks 50 are provided each with a fifth engaging portion 51 on the lower inner portion thereof. The shape of the fifth engaging portion 51 is conformed partially with that of the third engaging portion 31 of a third blocks 30 and partially with that of the fourth engaging portion 41 of a fourth block 40 neighboring therewith, and abuts against and limited by the bottom arciform surfaces of the pending portions of the third block 30 and the fourth block 40. The fifth blocks So thereby are restrained from dropping, but can be moved together with their neighboring fourth blocks 40 along the bottom arciform surfaces of the lateral sides of their neighboring second blocks 20 and of their neighboring third blocks 30; or can be moved together with their neighboring third blocks 30 along the bottom arciform surfaces of the front protruding edges of the tops of their neighboring second blocks 20.

Figure 20:
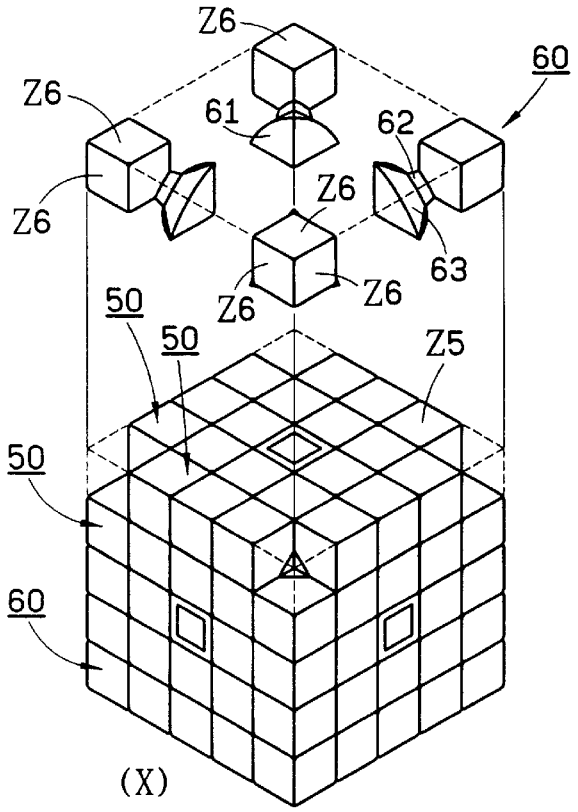
FIG. 20 is a perspective view showing the positions of the sixth blocks of the present invention.
Figure 21:
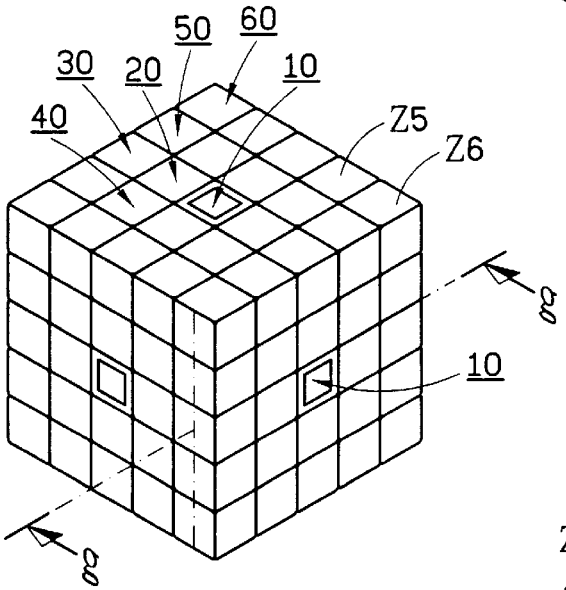
FIG. 21 is a perspective view showing the positions of the sixth blocks after they are assembled in the five-layer intellectual cube of the present invention.
Figure 22:
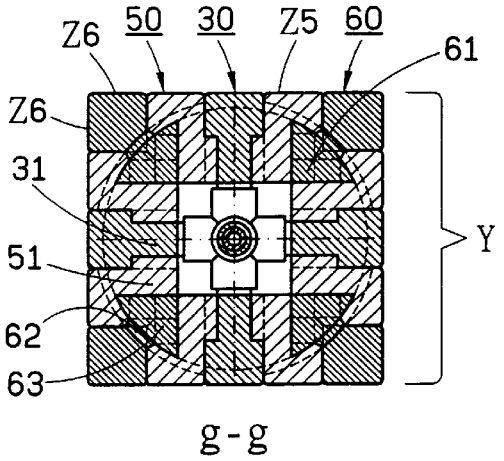
FIG. 22 is a sectional view taken from the sectional line g—g in FIG. 21.

Referring to FIGS. 20 to 22 showing the structure of the sixth blocks 60 and their positions on the intellectual square cube X. The sixth blocks 60 are hollow and are provided on the eight corners of the five-layer intellectual cube X, and each includes three outer surfaces as three smaller movable surfaces Z6 perpendicular to one another. The three smaller or square-shaped movable surfaces Z6 are connected with one another with their outer edges, and abut the smaller movable surfaces ZS of the fifth blocks 50 with their inner edges. Each sixth block 60 is provided with a lower sixth engaging block 61 which is provided with a neck 62 and an engaging portion 63. The engaging portion 63 is in the shape in conformity with that of one of two laterals of each of three of the fifth portions blocks 51 of three fifth blocks 50 neighboring therewith. The engaging portion 63 has five sides 63*a–e* where two of the sides 63*d–e* are perpendicular to each other and three of the sides 63*a–c* are not. The two perpendicular sides 63d–e and three non-perpendicular sides 63*a–c*, respectively, have equal length and width dimensions. The top of the engaging portion 63 is arciform and is restrained by a plurality of recesses provided just above the aforesaid lateral ledges of these fifth blocks 50, so that the sixth blocks 60 can be prevented from dropping, and can be moved together with any of these fifth blocks 50.

By mutual restraint and limitation of the neighboring blocks 10–60 by their specific shapes and sizes, and the movability of the smaller or square-shaped movable surfaces Z (Z1–Z6), (when all the smaller movable surfaces Z are applied with colors or patterns and when some blocks and their surficial smaller movable surfaces 7 are moved to change positions), the six sides Y of the five-layer intellectual cube X can have various combinations of colors or patterns. In addition, the specificity to which the block shapes are made is important as the specific block shapes assist with the mutual restraint and limitation of their neighboring blocks 10–60. The mutual restraint and limitation to which each of the blocks 10–60 conform is dependent on the intricate shapings of the pieces as claimed. These shapings ensure precise fittings between the blocks in the most efficent manner to provide intellectual stimulation to the user. Thus, the brain can get an intellectual enhancing effect, and the game can increase complexity of the intellectual cube X.

The above paragraphs stated the structure and the relative positions of the components of the intellectual cube X of the present invention. When the components are assembled, by mutual restraint and limitation of the neighboring components taking the six first blocks 10 as their original limited members, and when assembling from the innermost components toward the outermost components, the top first block 10 must be assembled lastly in order that in no case that assembling of the components can not be completed; in practicing, assembling shall follow the steps shown in FIG. 1 and FIG. 23 to 35.

Figure 23:
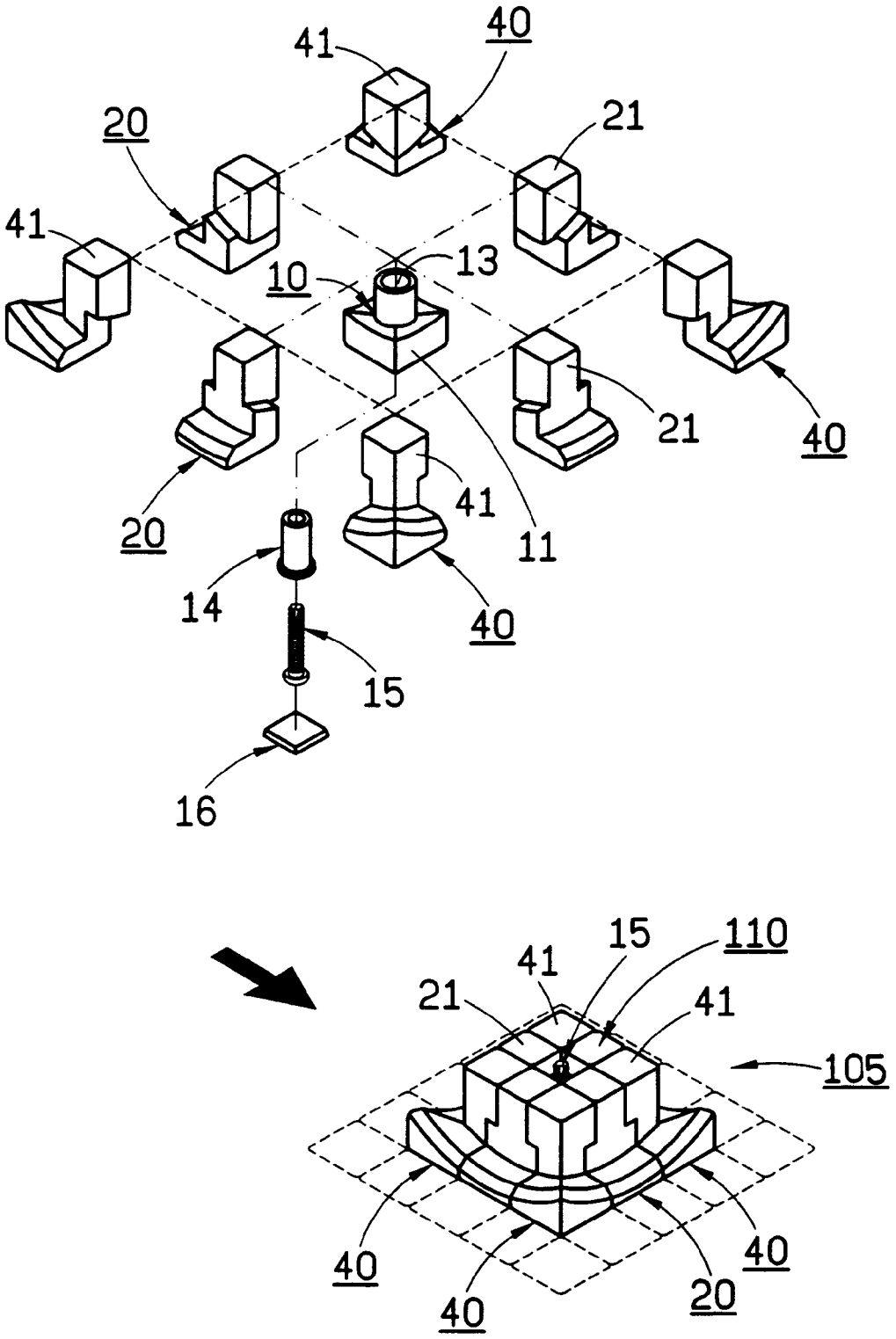
FIG. 23 is an analytic perspective schematic view showing the first step in assembling of the present invention.

The first step is shown in FIG. 23, when assembling, a rotatable plate 11 of a first block is faced down. A sleeve 14 and a screw 15 are inserted into a through hole 13 provided-in the first block 10, then four second blocks 20 are placed to abut the four sides of the first block 10. Four fourth blocks 40 are placed so that each fourth block 40 is positioned between two second blocks 20, and, therefore, all the second blocks 20 and the fourth blocks 40 surround the six first blocks 10 to form a sub-unit 105 in which the engaging portions of the second and fourth blocks form a block shaped extension 110 with a square perimeter.

Figure 24:
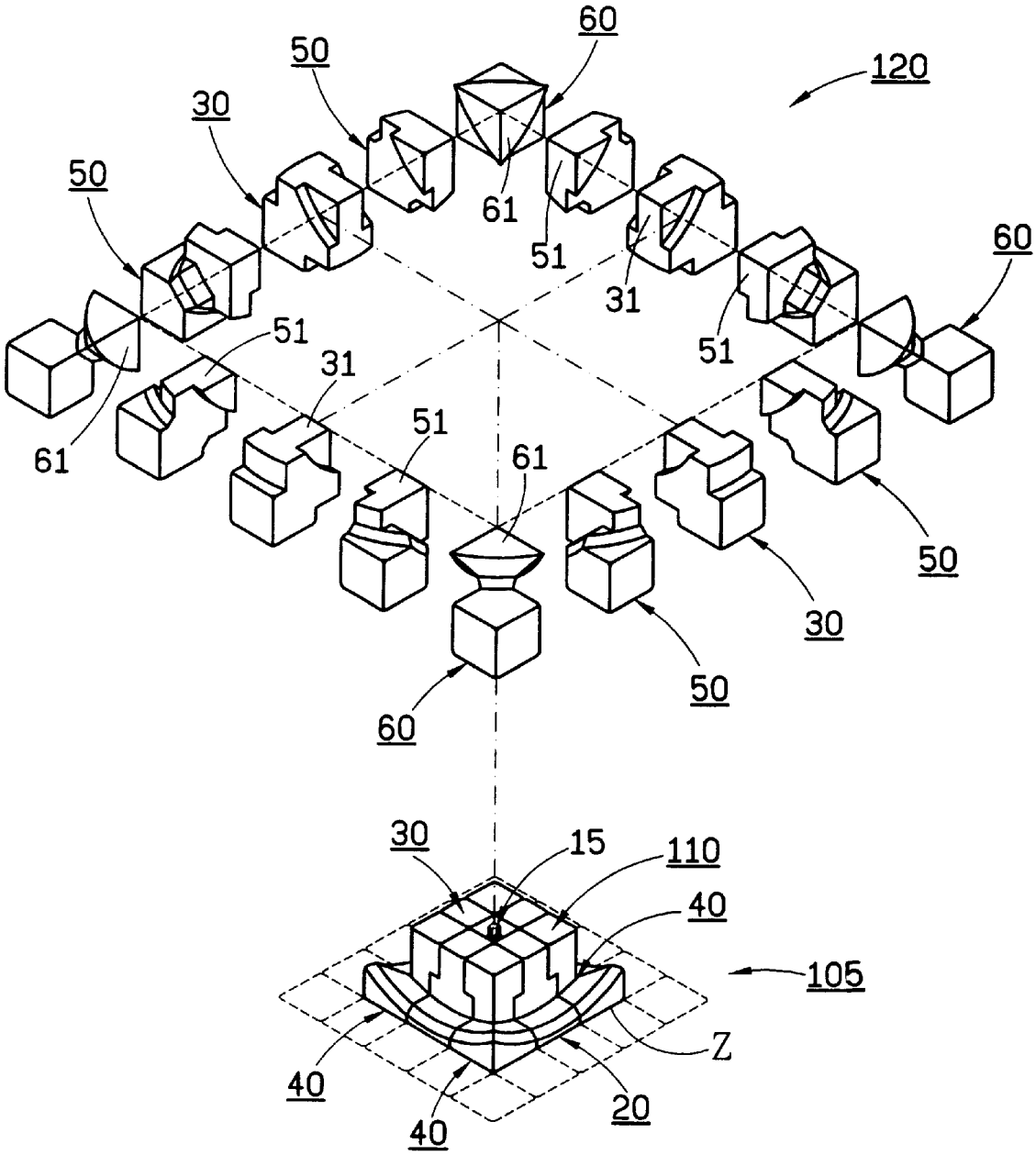
FIG. 24 is an analytic perspective view showing the second step in assembling of the present invention.
Figure 25:
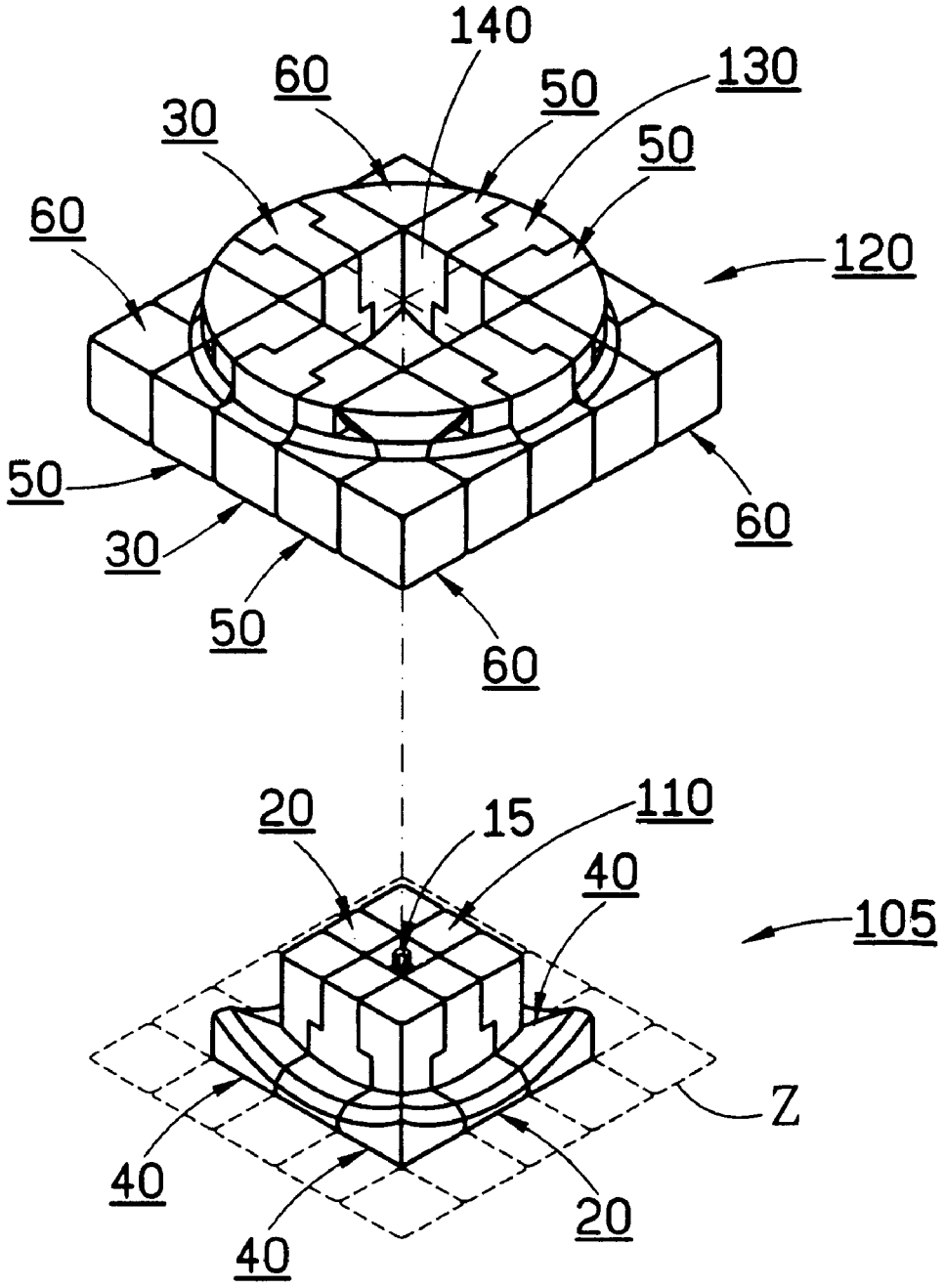
FIG. 25 is a schematic view showing the second step in assembling of the present invention.

The second step is shown in FIGS. 24 and 25. When the above components are assembled, nine smaller movable surfaces Z are faced down, one more circle of the components that form other smaller movable surfaces Z, the bottom square side Y can be completed (referring to FIG. 26). The components and the relative positions thereof are arranged like this: four third blocks 30 are placed at the outer edges of the four second blocks 20 respectively. A fifth block 50 is placed on both lateral sides of each third block 30, and lastly, a sixth block 60 is provided on one of the four corners of the bottom layer to form a sub-unit 120 having a disc or cylinder-shaped extension 130 with a square central opening 140 which, together with sub-unit 105, completes the first layer.

Figure 26:
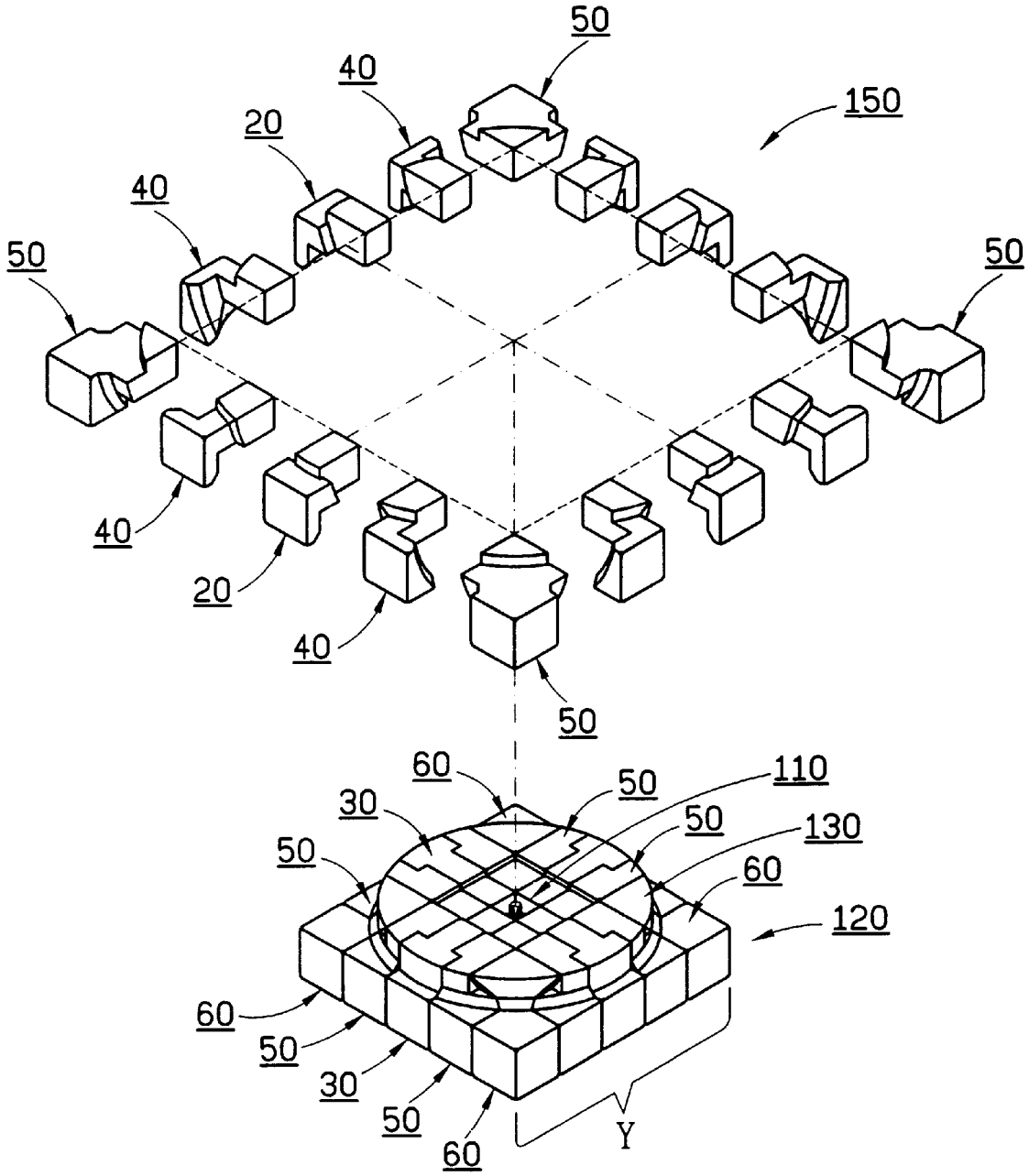
FIG. 26 is an analytic perspective view showing the third step in assembling of the present invention.
Figure 27:
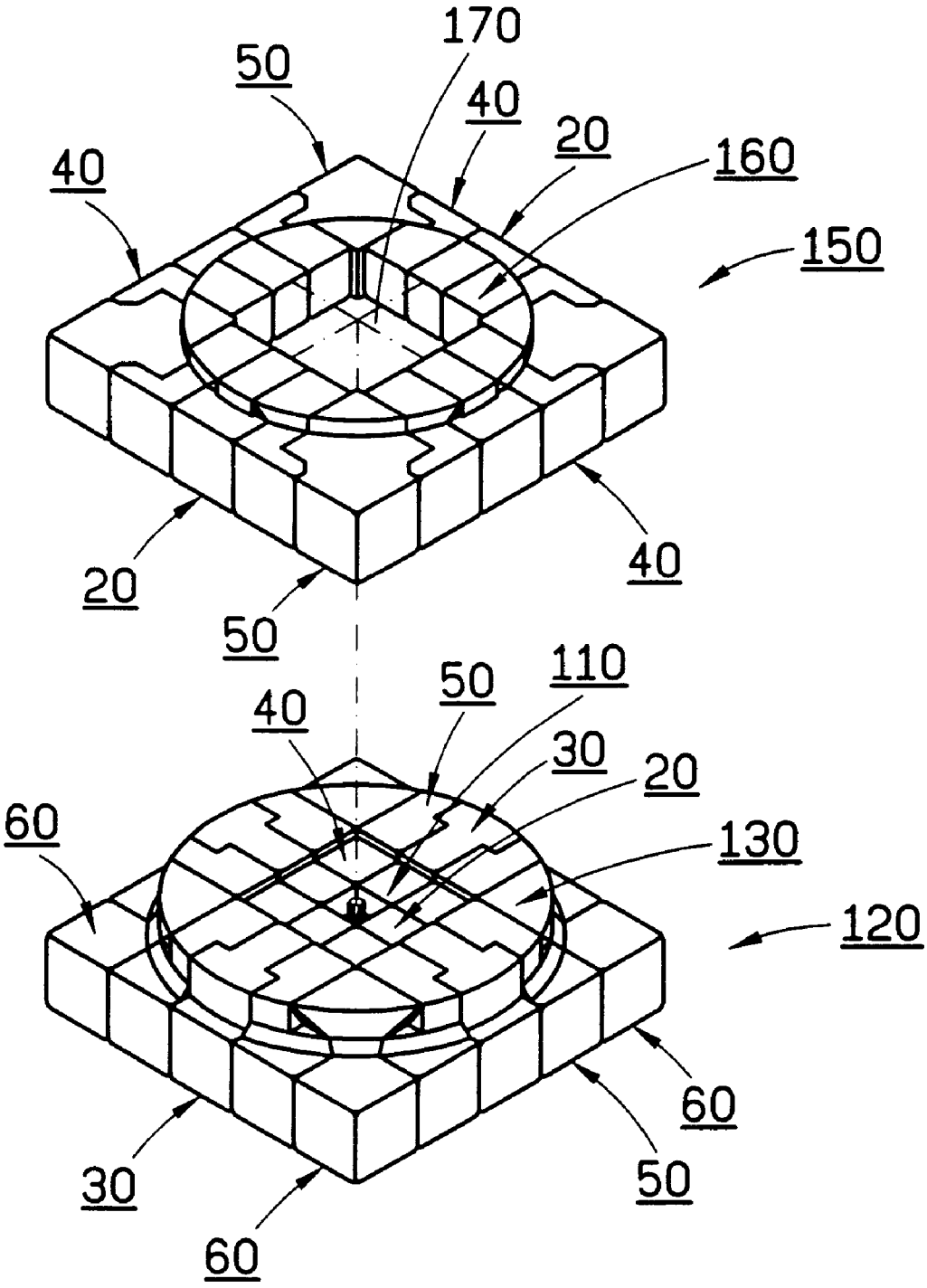
FIG. 27 is a schematic view showing the third step in assembling of the present invention.

As shown in FIGS. 26 and 27, when the second step is completed, the bottom layer of the five-layer intellectual cube X is completed. A whole side Y facing downwards is thereby obtained, and the assembling now is continued from the third step. In the third step, the four third blocks 30 of the aforesaid first layer are added thereabove each with a second block 20, and the eight fifth blocks 50 in this layer are added thereabove each with a fourth block 40. These eight fourth blocks 40 are located respectively at both sides of the just assembled second blocks 20, and lastly, the four sixth blocks 60 in the first layer and located on the four comers are respectively added each with a fifth block 50 to form a sub-unit 150 having a disc or cylinder-shaped extension 160 with a square opening 170. In this way, the second layer of the five-layer intellectual cube X is completed.

Figure 28:
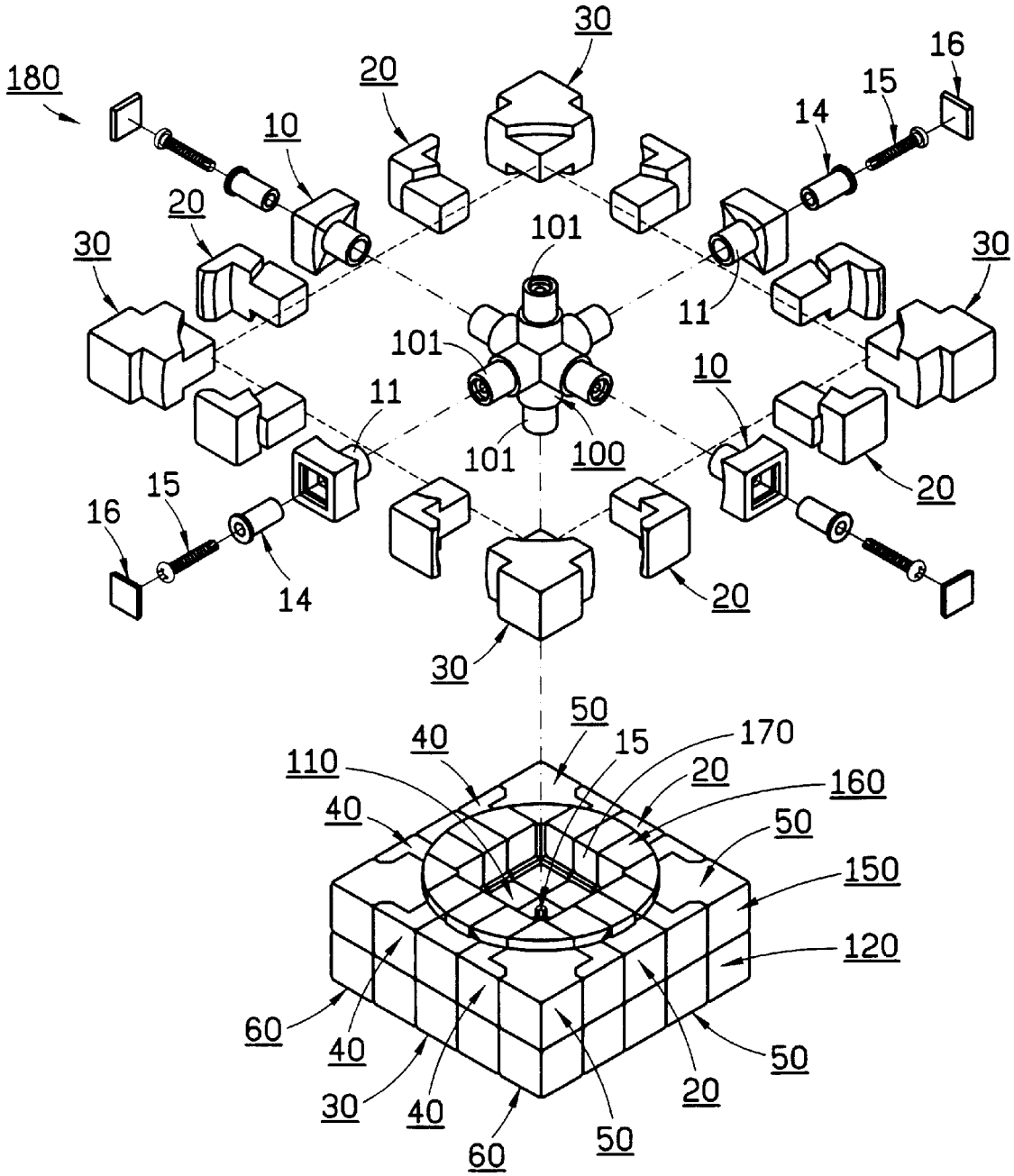
FIG. 28 is an analytic perspective view showing the fourth step in assembling of the present invention.
Figure 29:
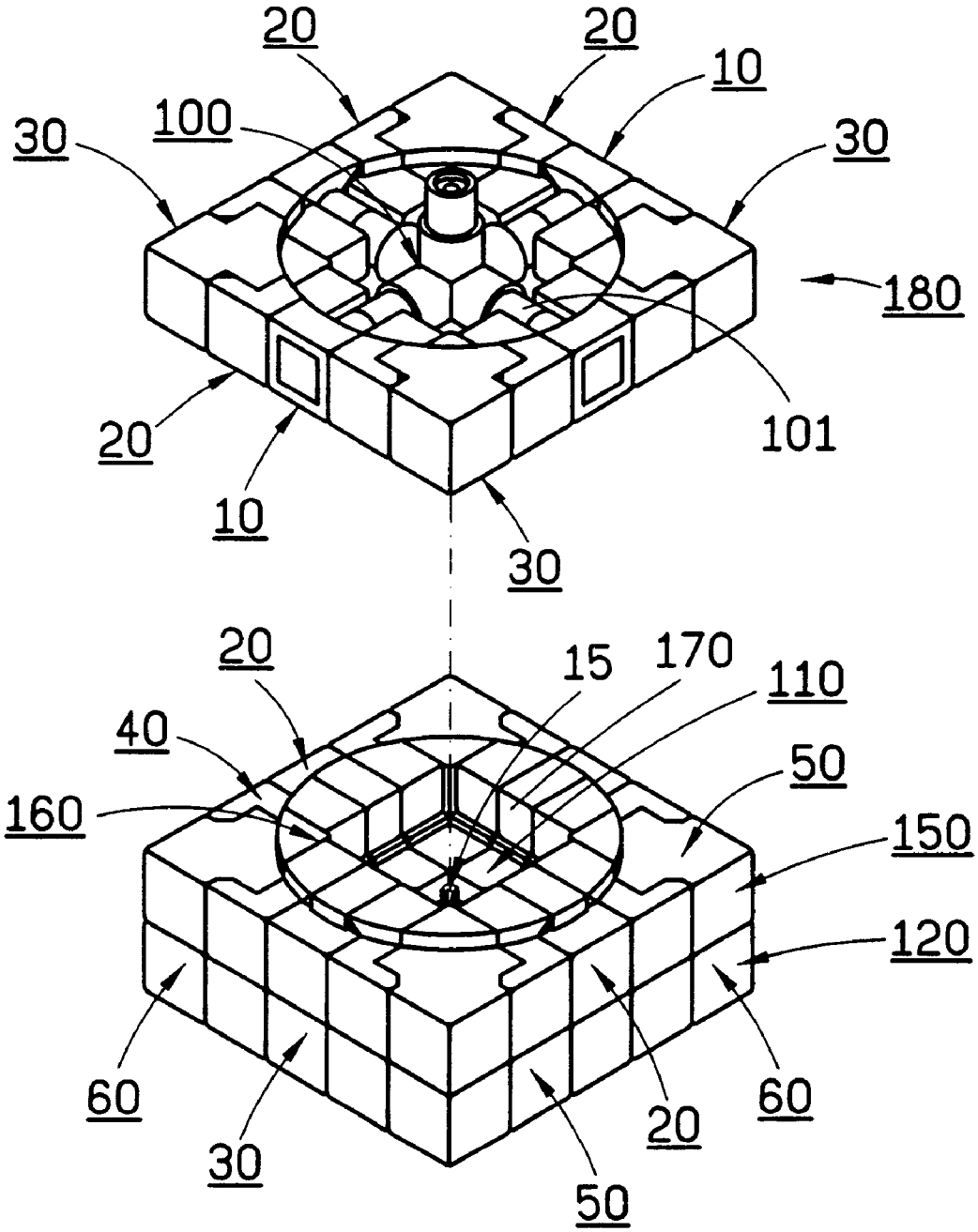
FIG. 29 is a schematic view showing the fourth step in assembling of the present invention.

The fourth step is shown in FIGS. 28 and 29, when the second layer is completed, an opening made up of openings 140 and 170 is formed at the center thereof. The screw 15 mentioned in the first step is located and exposed here at the center. The axle rod 101 directing downward from the central axle block 100 can be screwed tight by the screw 15. The first block 10 in the first step can then be covered with a lid 16. The axle rod 101 on the top of the central axle block 100 directs upwardly when it is screwed tight, and the four lateral axle rods 101 are located to be perpendicular to the four lateral sides Y of the five-layer intellectual cube X respectively. Then four third blocks 30 are placed at the four corners, i.e., on the four fifth blocks So in the second layer, and eight second blocks 20 are placed at two mutual orthogonal sides of each of the four third blocks 30 and on the eight fourth blocks 40 in the second layer; and lastly, four lateral first blocks 10 are respectively mounted on the tailing ends of the four lateral axle rods 101 by-means of a plurality of the aforesaid sleeves 14, screws 15 and lids 16. Finally, the four lateral first blocks 10 are located respectively on the second blocks 20 in the second layer to complete sub-unit 180. In this way, the third layer of the five-layer intellectual cube X and assembly of the central axle block 100 are completed.

Figure 30:
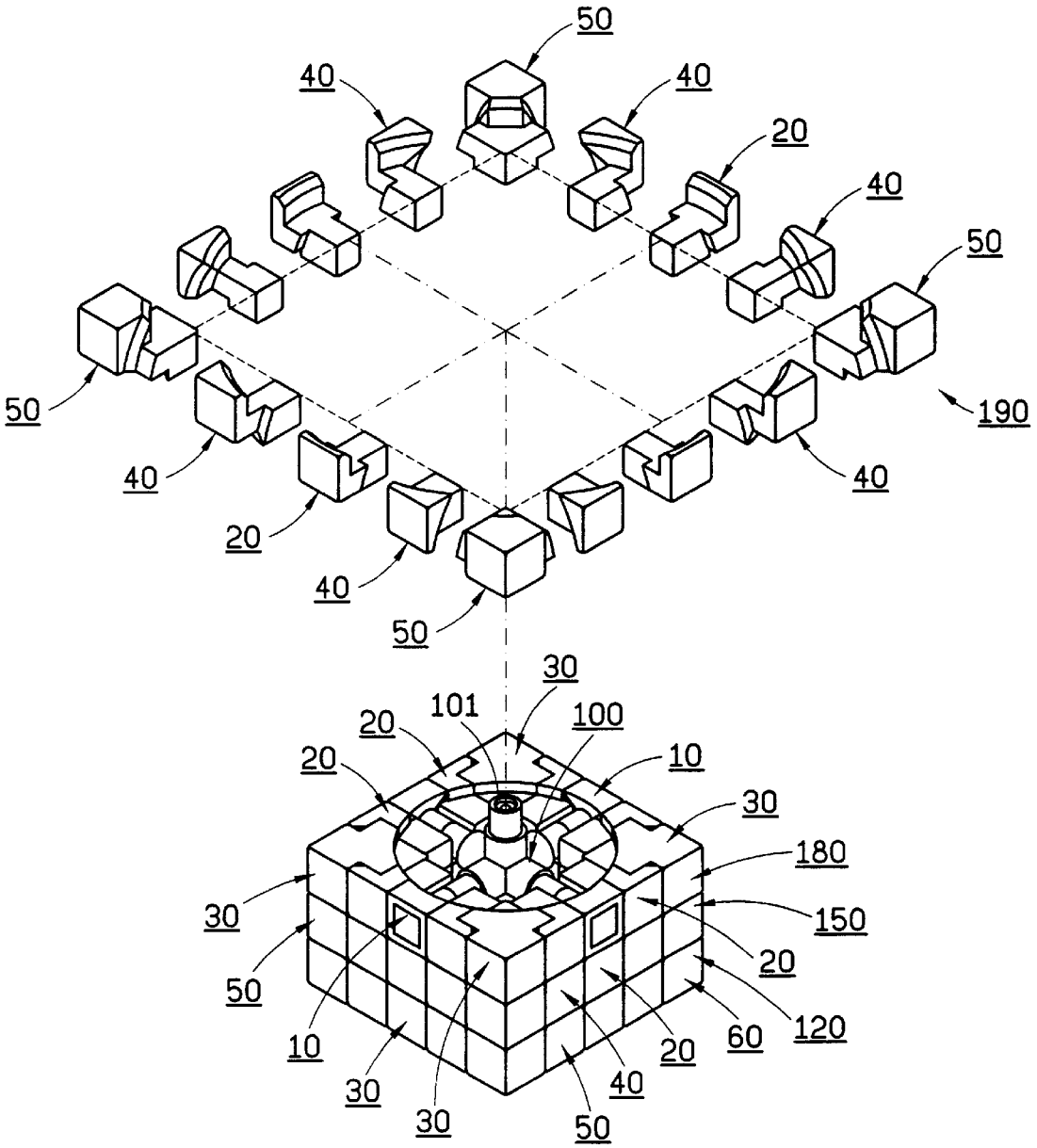
FIG. 30 is an analytic perspective view showing the fifth step in assembling of the present invention.
Figure 31:
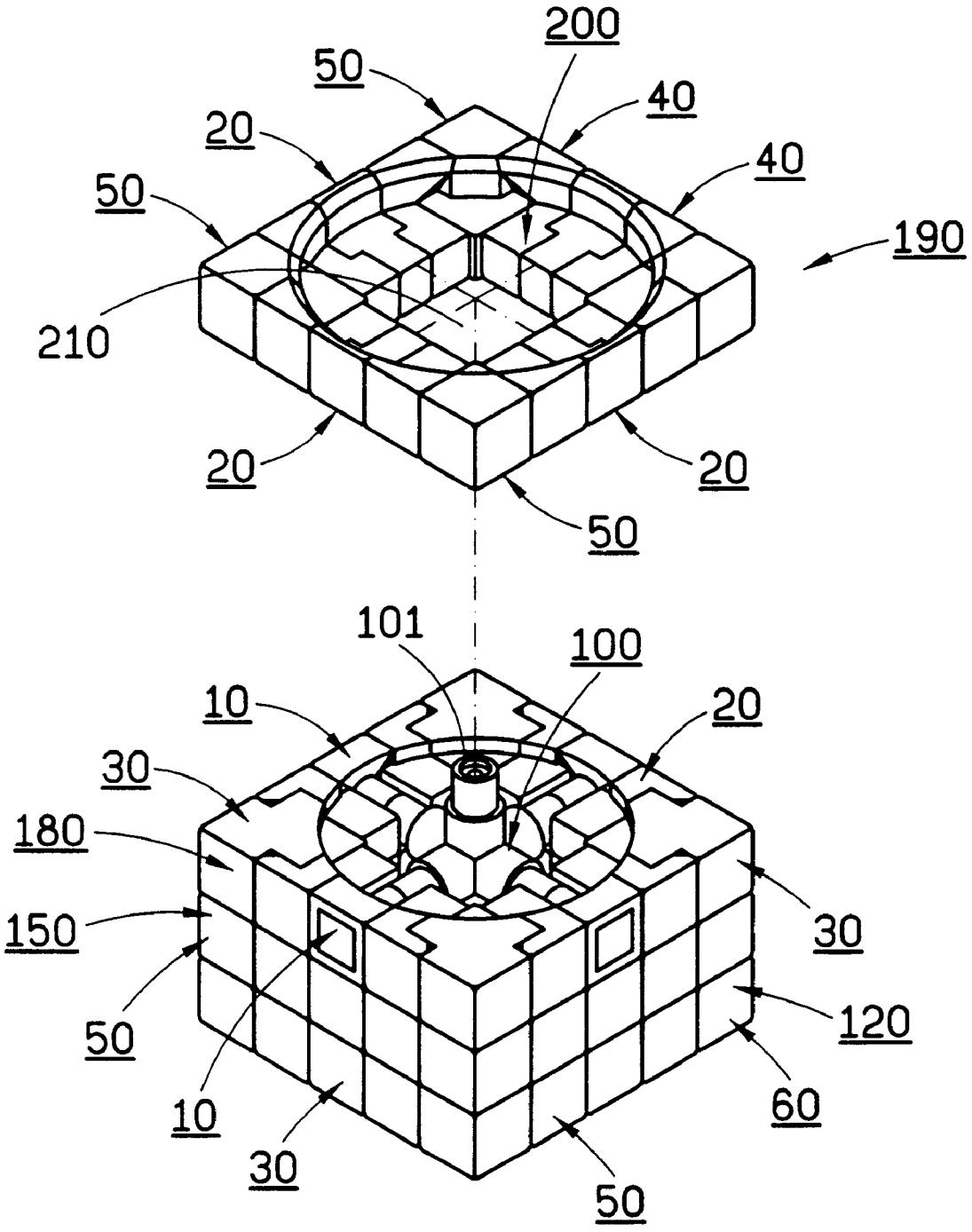
FIG. 31 is a schematic view showing the fifth step in assembling of the present invention.

The fifth step is shown in FIG. 30 and 31, the components for assembling therein are identical to those in the third step, but in the contrary orientation. They include four second blocks 20, eight fourth blocks 40 and four fifth blocks 50. The order of assembling is like this: the four fifth blocks 50 are in the first place provided at the four comers, i.e., on the four third blocks 30 in the third layer; then the eight fourth blocks 40 are placed respectively on two mutual orthogonal sides of each of the four fifth blocks 50; and lastly, the four second blocks 20 are placed each between two of the fourth blocks 40just assembled and on the four first blocks 10 in the third layer to form a sub-unit 190 having a discoidal or cylindrical extension 200 and square opening 210. In this way, the fourth layer of the five-layer intellectual cube X is completed.

Figure 32:
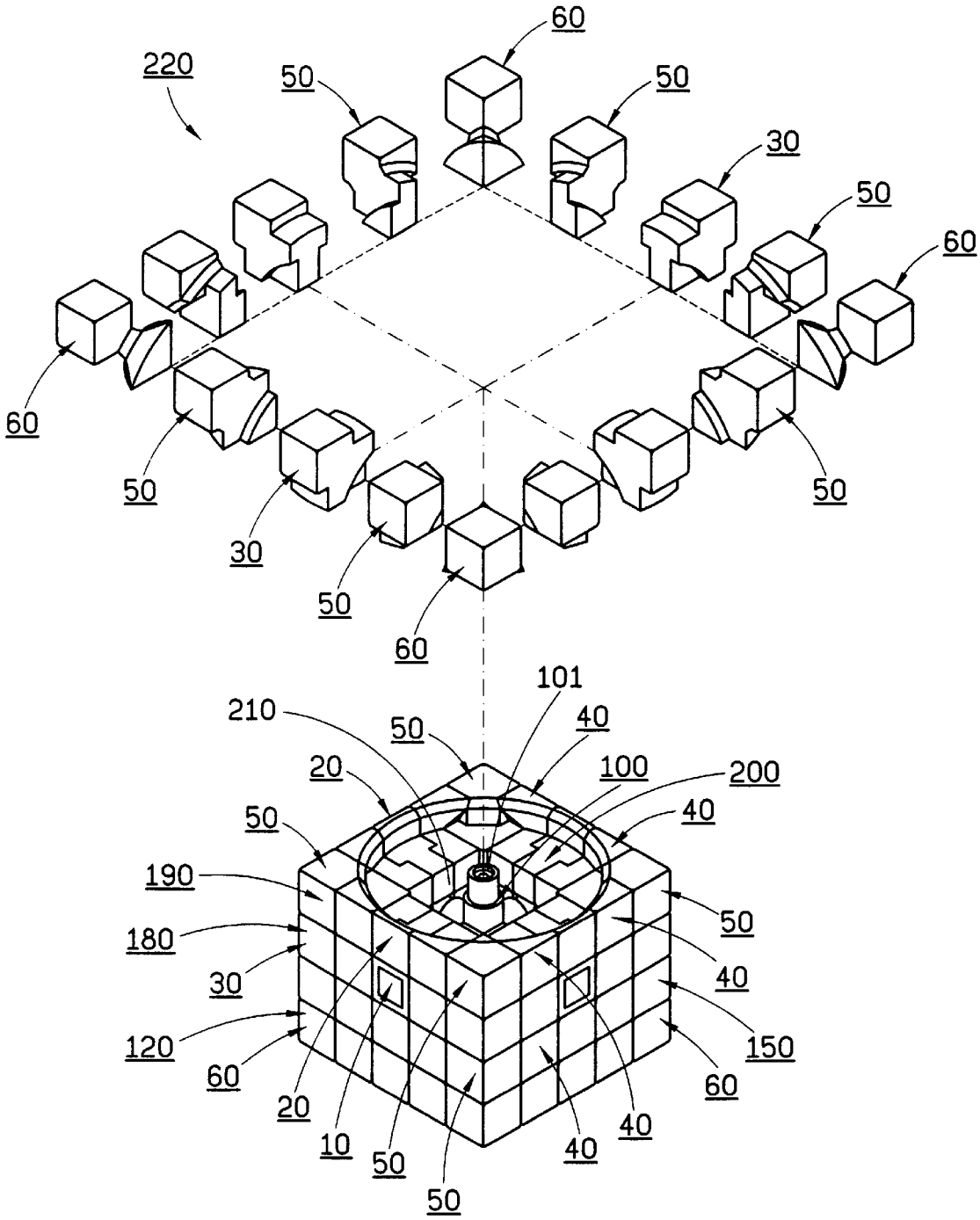
FIG. 32 is an analytic perspective view showing the sixth step in assembling of the present invention.
Figure 33:
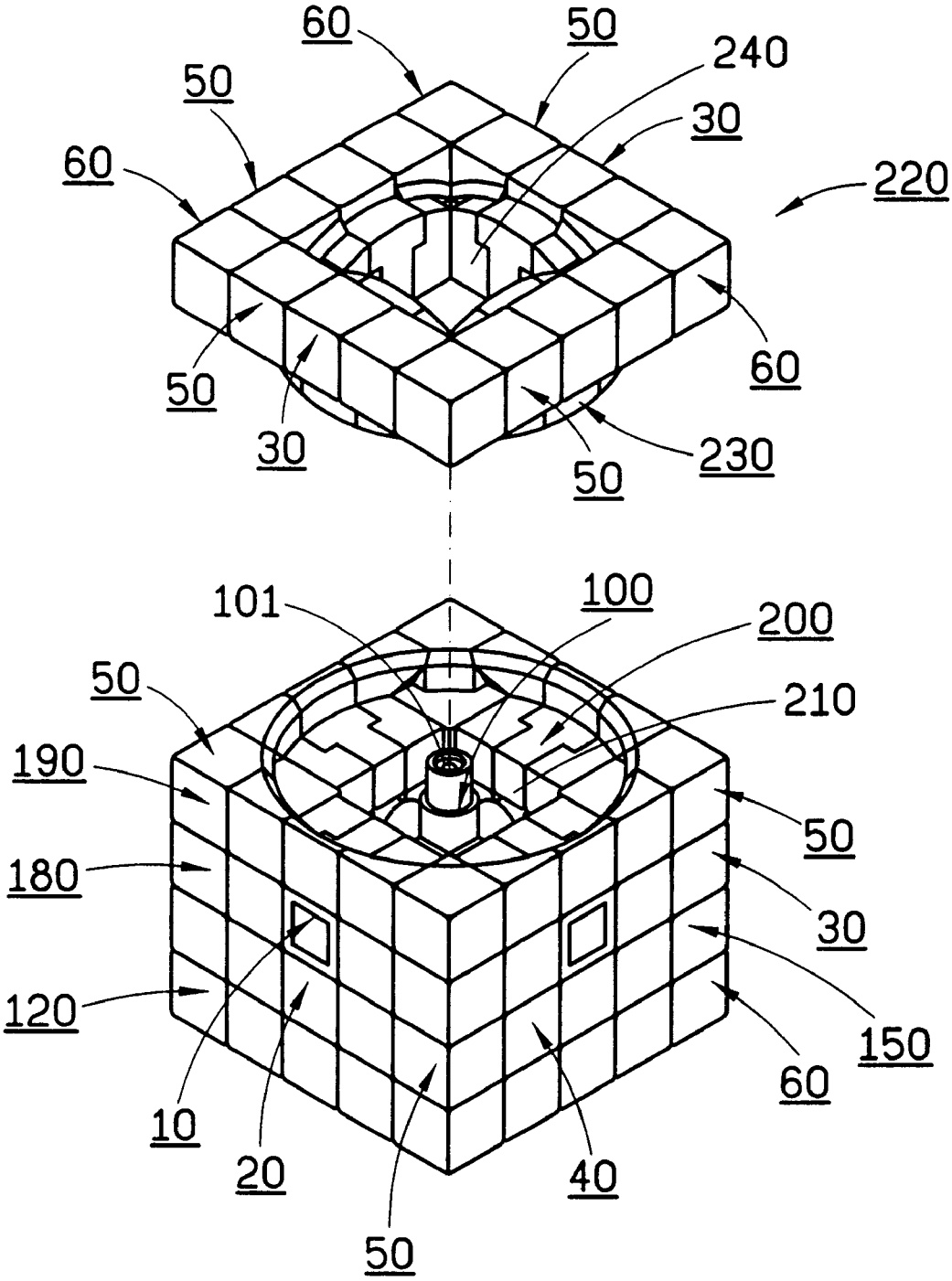
FIG. 33 is a schematic view showing the sixth step in assembling of the present invention.

The sixth step is shown in FIGS. 32 and 33. The components for assembling therein are identical to those in the second step, but in the contrary orientation. They include four third blocks 30, eight fifth blocks 50 and four sixth blocks 60. The order of assembling is like this: the four sixth blocks 60 are in the first place provided at the four corners, i.e., on the four fifth blocks 50 in the fourth layer. The eight fifth blocks 50 are placed respectively on two mutual orthogonal sides of each of the four sixth blocks 60 just assembled and on the eight fourth blocks 40 in the fourth layer. Lastly, the four third blocks 30 are placed each between two of the fifth blocks 50 just assembled and on the four second blocks 20 to form a sub-unit 220 having a discoidal or cylindrical extension 230 and square opening 240. In this way, the sixth step is completed.

Figure 34:
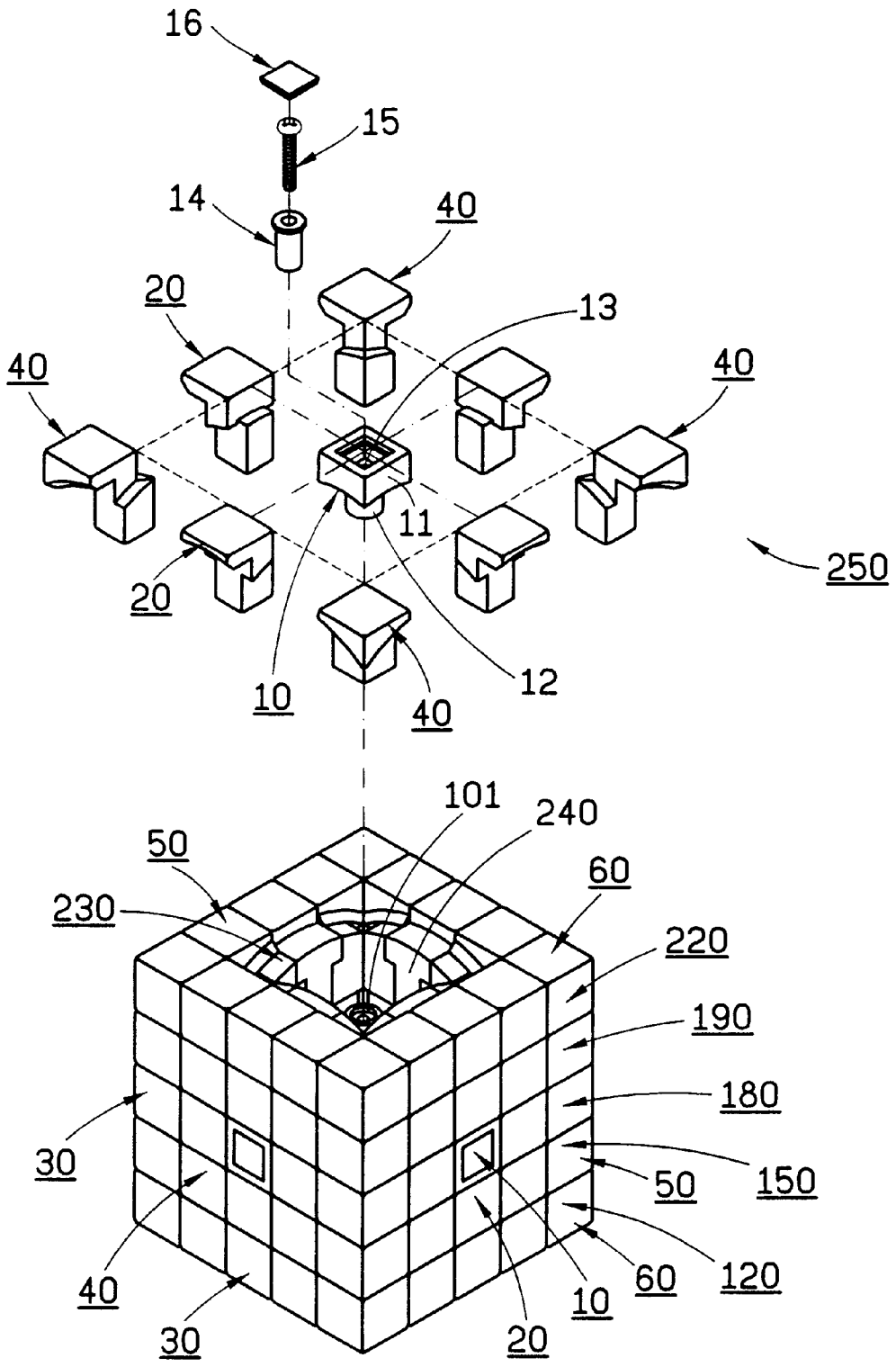
FIG. 34 is an analytic perspective view showing the seventh step in assembling of the present invention.
Figure 35:
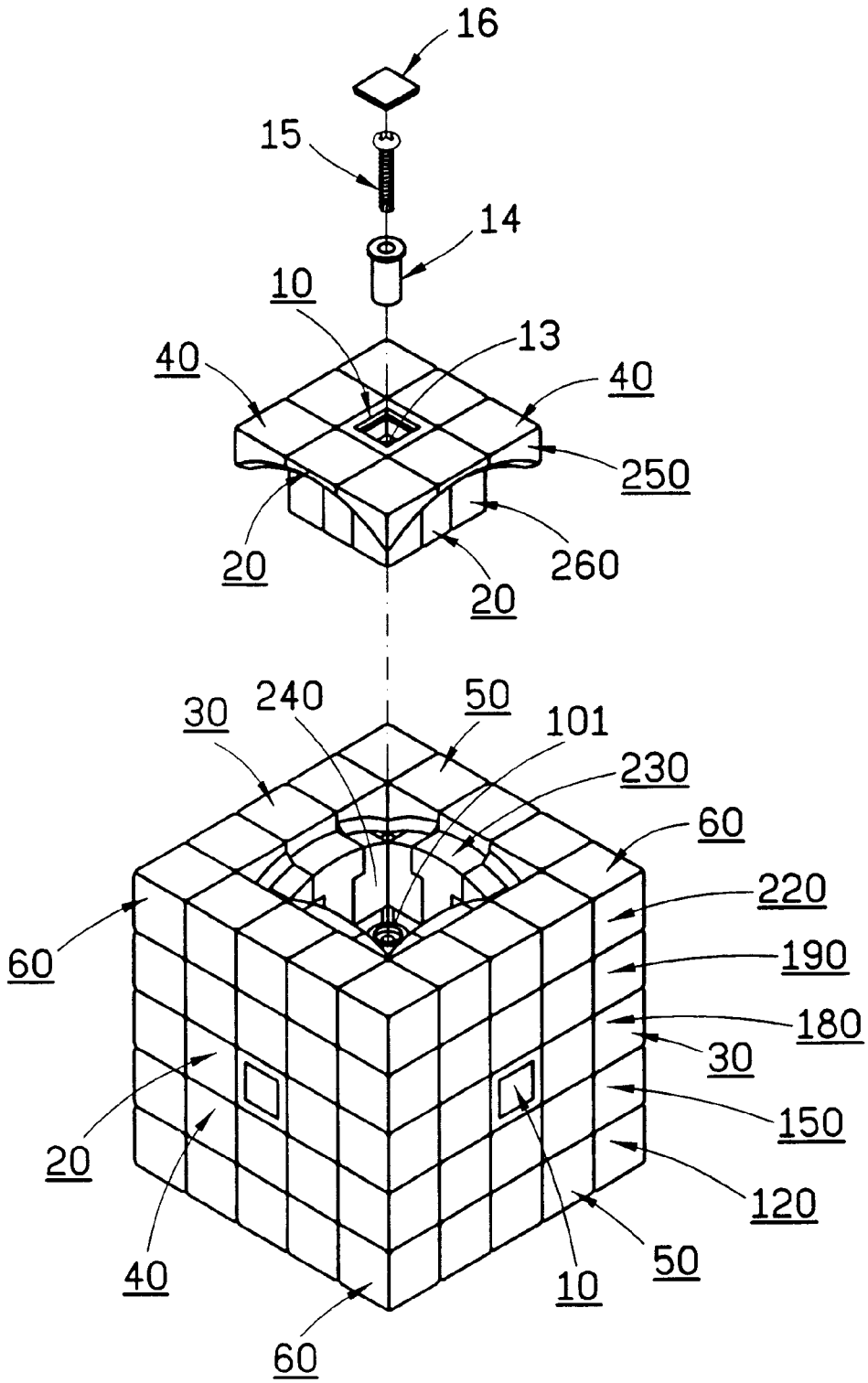
FIG. 35 is a schematic view showing the seventh step in assembling of the present invention.

As shown in FIGS. 34 and 35, when the sixth step is completed, the circumferential of the fifth layer or the top layer of the five-layer intellectual cube X is completed. However, the opening 240 is left at the central area of this layer, and the axle rod 101 on the top of the central axle block 100, extends upwardly through openings 210 and 240 and is located at the center of the openings. The four lateral sides Y and the bottom side Y assembled in the first and the second steps (totally five sides) are now completed. In the seventh step, some more blocks are added to the opening 240 to complete the top layer or the top side Y. The whole assembly can be completed then. In this step, the components used are identical to those of the first step, but in the contrary orientation. They include a first block 10, four second blocks 20 and four fourth blocks 40. The order of assembling is like this: the four second blocks 20 and the four fourth blocks 40 are placed at the periphery to form sub-unit 250 having a square extension 260 that fits in opening 240. The first block 10 is mounted according to the above stated method and by means of a through hole 13, a sleeve 14, a screw 15 and a lid 16 on the axle rod 101 directing upwardly at the center of the depression. The first block 10 is restrained on the axle rod 101, and the rotatable plates 11 of the first block 10 can restrain the abovementioned four second blocks 20 and four fourth blocks 40. These four second blocks 20 and four fourth blocks 40 in turn can restrain the other outer components (the components assembled in the sixth step). In this way, the five-layer intellectual cube X is completed.

Figure 36:
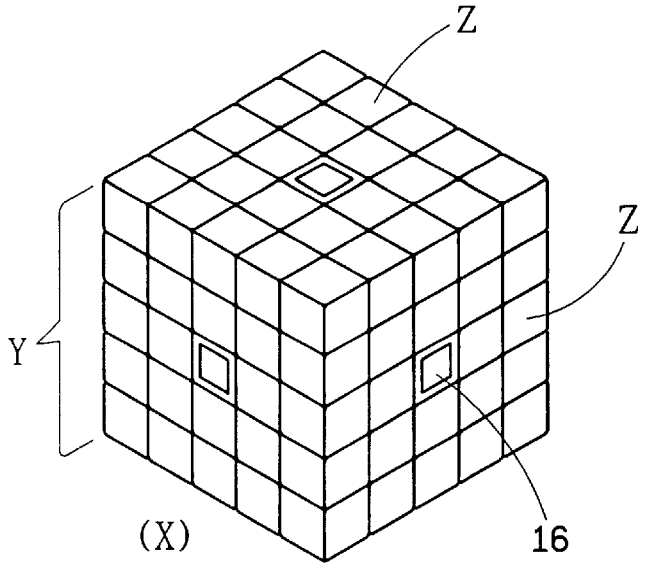
FIG. 36 is a perspective view showing the appearance of the present invention after assembling.
Figure 37:
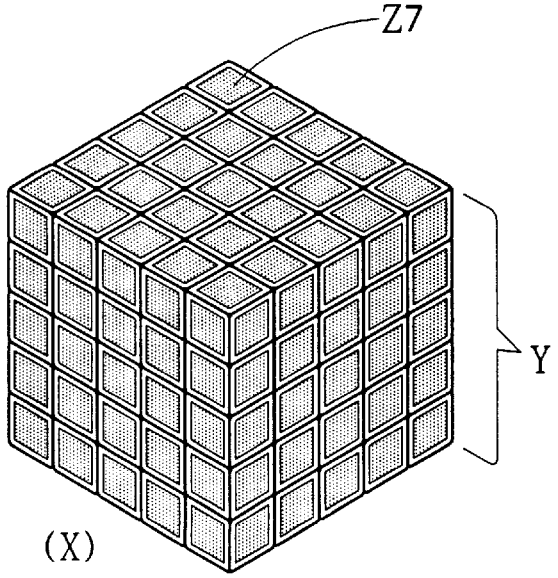
FIG. 37 is a perspective view showing the appearance of another embodiment of the present invention after assembling.

As shown in FIGS. 36 and 37, when assembling of all the components is completed, the five-layer intellectual cube X is rotatable for playing in the ways shown in FIG. 2. The six sides Y of the five-layer intellectual cube X can have various combinations of colors or patterns to get an intellectual enhancing effect. This can be done by applying colors on the smaller movable surfaces Z. Moreover, in order to avoid destruction of the whole appearance by above stated lids 16 on the first blocks 10., stickers Z7 of various colors or patterns can be applied on all the smaller movable surfaces Z. A finished article of the five-layer intellectual cube X can thus be completed.

When practicing the present invention, in order not to make a too large difficulty for a learner of the game, the six sides Y are only applied with two or three colors or patterns.

The names of the components composing the present invention and the shapes shown in the drawings are intended only for illustrating a preferred embodiment of the present invention, and not for giving any limitation to the scope of the present invention. Those skilled in this art can understand how to do some modifications or changes to the components of the present invention.

Figure 38:
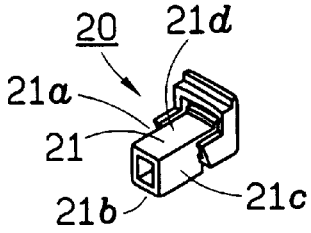
FIG. 38 is a perspective view of an embodiment of a second block of the present invention.
Figure 39:
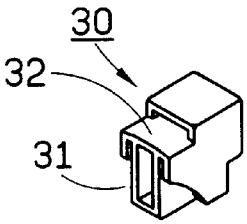
FIG. 39 is a perspective view of an embodiment of a third block of the present invention.
Figure 40:
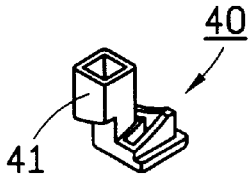
FIG. 40 is a perspective view of an embodiment of a fourth block of the present invention.
Figure 41:
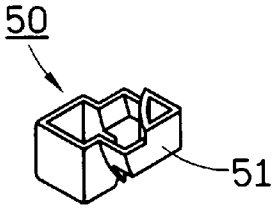
FIG. 41 is a perspective view of an embodiment of a fifth block of the present invention.
Figure 42:
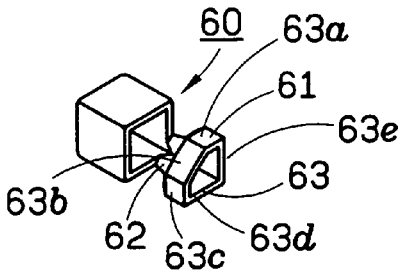
FIG. 42 is a perspective view of an embodiment of a sixth block of the present invention.

For example, the second blocks 20 to the sixth blocks 60 in FIGS. 38 to 42 are made by the technique of injection moulding of plastic. The blocks are all hollow, and this can prevent the plastisol from deformation and weight reducing during cooling, which is beneficial to mass production. FIG. 38 shows that the top portion and the inner bottom portion of a second block 20 are excavated to be hollow. FIG. 39 shows that a third block 30 and the third engaging block 31 thereon are hollow. FIG. 40 shows that a fourth block 40 and the fourth engaging block 41 thereon are hollow. FIG. 41 shows that a fifth block 50 and the fifth engaging block 51 thereon are hollow. FIG. 42 shows that a sixth block 60 and the engaging portion 63 thereon are hollow. Further, in manufacturing, all the engaging blocks or engaging portions are provided with arciform surfaces, so that movement of the blocks can be smooth.

The embodiments stated above are only examples for illustrating the present invention. It will be apparent to those skilled in this art that various modifications or changes can be made to the components of the present invention without departing from the spirit, scope and characteristic of this invention. Accordingly, all such modifications and changes also fall within the scope of the appended claims and are intended to form part of this invention.

What is claimed is:

1. A five-layer intellectual cube having six sides, each side having 25 square-shaped movable surfaces with different colors or patterns arranged vertically and horizontally into five rows and columns respectively, said cube comprising a central axle block, six first blocks, twenty-four second blocks, twelve third blocks, twenty-four fourth blocks, twenty-four fifth blocks and eight sixth blocks, wherein:

said central axle block is located at a center of said five-layer intellectual cube six axle rods being each provided on said central axle block, said axle rods extending perpendicular to each one of said six sides;

said first blocks are each in the shape of a "T" having top surfaces that face outwardly and form rotatable plates of four sides, a rotation axle being provided on a bottom surface of each of said rotatable plates and said bottom surfaces all having arciform shapes, said rotation axles being pivotally inserted into each of said six axle rods of said central axle block, each of said first blocks being rotatable about one of said axle rods, and said top surfaces of said rotatable plates each forming a square-shaped movable surface positioned exactly at a center of one of said six sides;

said second blocks have side surfaces each in the shape of an "L", rear sides that abut the four edges of said rotatable plates of said first blocks, and top surfaces each forming a square-shaped movable surface and being located respectively at said four edges of said square-shaped movable surfaces of each of said rotatable plates, said second blocks being provided on said rear sides with a second engaging portion, said second engaging portion protruding rearwardly to extend to a lower portion of one of said rotatable plates, said second engaging portion having an arciform-shaped top ledge arranged to abut against a respective arciform-shaped bottom surface of said rotatable plate;

said third blocks each have a square-shaped top surface and a square-shaped lateral surface extending perpendicular to the square-shaped top surface, an intersection of said square-shaped top and lateral surfaces being located exactly at a corner where two neighboring sides of said five-layer intellectual cube orthogonally interconnect to each other, an inner side of each of said third blocks abutting an outer side of a respective said square-shaped movable surface of said second blocks so that said top and lateral square-shaped surfaces of each of said third blocks abuts said square-shaped movable surfaces of two of said second blocks provided on two neighboring sides respectively, each of said third blocks having a third engaging portion attached to its lower portion, said third engaging portion being arranged to abut the second engaging portions of said second blocks such that said third blocks are retained in said intellectual cube by engagement between said third engaging portion of said third block and said protruding portions of said second blocks;

said fourth blocks have movable square-shaped top surfaces, said movable square-shaped surfaces abutting the four corners of the four sides of said first blocks and the two inner edges of each of said square-shaped surfaces neighboring edges of two square-shaped surfaces of two of said second blocks, said fourth blocks and said second blocks surrounding said six first blocks, and said fourth blocks being provided with a fourth engaging portion that protrudes toward said rotation axle of one of said first blocks and toward said second engaging portions of two of said second blocks, a bottom surface of a protruding portion of each said fourth block abutting the bottom surfaces respectively of said square-shaped movable surfaces of one of said first blocks and corresponding second blocks to retain said fourth block in said intellectual cube;

said fifth blocks are provided at two lateral sides of said third blocks, said fifth blocks having a top on one side and a lateral surface on another side, said sides being perpendicular to each other to each form a square-shaped movable surface, said square-shaped movable surfaces forming an intersection located exactly at a corner where two sides of said five-layer intellectual cube orthogonally interconnect, said fifth blocks having an inner side that abuts an outer side of said square-shaped movable surface of one of said fourth blocks, and outer sides that are perpendicular to each other, and said fifth blocks being provided with a fifth engaging portion on a lower inner portion, each said fifth engaging portion conforming partially with said third engaging portion of said third blocks and partially with a respective said fourth engaging portion of said fourth blocks neighboring therewith, said fifth engaging blocks being retained in said intellectual cube by engagement between said fifth blocks and said third and fourth blocks;

said sixth blocks are provided on the eight corners of said five-layer intellectual cube, said sixth blocks including three outer surfaces forming three square-shaped movable surfaces extending perpendicular to one another, said three square-shaped movable surfaces being connected with one another by their outer edges, said sixth blocks abutting said square-shaped surfaces of said fifth blocks by their inner edges, and said sixth blocks each being provided with a lower sixth engaging block having a neck and an engaging portion, said engaging portion having a shape that conforms to that of said lateral sides of said fifth engaging blocks neighboring therewith, and said sixth blocks being retained in said intellectual cube by engagement of said engaging portion with a plurality of recesses provided on said fifth blocks; said first, second, fourth, fifth, and sixth blocks being arranged in sub-units to facilitate assembly as follows:

one of said first blocks, four of said second blocks, and four of said fourth blocks forms a first sub-unit in which said second engaging portions of said second blocks and said fourth engaging portions of said fourth blocks form an extension having a square perimeter, four of said third blocks, eight of said fifth blocks, and four of said sixth blocks form a second sub-unit in which inside surfaces of said third engaging portions, said fifth engaging portions, and said sixth engaging portions together form a first square-shaped opening that fits over said extension of said first sub-unit to complete a first layer of said intellectual cube, and in which outside surfaces of said third, fifth, and sixth engaging portions form a cylindrical extension of said second sub-unit;

four of said second blocks, eight of said fourth blocks, and four of said fifth blocks form a third sub-unit arranged to fit over said cylindrical extension of said second sub-unit, inside surfaces of said second, fourth, and fifth engaging sections being arranged to form a second square-shaped opening through which extends a first of said axle rods, and in which outside surfaces of said second, fourth, and fifth blocks form a cylindrical extension of said third sub-unit, said third sub-unit forming a second layer of said intellectual cube;

four of said first blocks, eight of said second blocks, four of said third blocks, and second, third, fourth, and fifth ones of said axle rods form a fourth sub-unit arranged to fit over said cylindrical extension of said second sub-unit and thereby provide a third layer of said intellectual cube;

four of said second blocks, eight of said fourth blocks, and four of said fifth blocks form a fifth sub-unit having a structure identical to said third sub-unit, including a cylindrical extension fitted into an opening in said fourth sub-unit and a third square-shaped opening formed by inside surfaces of said second, fourth, and fifth engaging sections and through which one of said axle rods extends, said fifth sub-unit forming a fourth layer of said intellectual cube;

four of said third blocks, eight of said fifth blocks, and four of said sixth blocks form a sixth sub-unit in which inside surfaces of said third engaging portions, said fifth engaging portions, and said sixth engaging portions together form a fourth square-shaped opening, and in which outside surfaces of said third, fifth, and sixth engaging portions form a cylindrical extension arranged to fit into a cylindrical opening in said fifth sub-unit;

one of said first blocks, four of said second blocks, and four of said fourth blocks forms a seventh sub-unit in which said second engaging portions of said second blocks and said fourth engaging portions of said fourth blocks form an extension having a square perimeter, said extension of the seventh sub-unit being arranged to fit into the fourth square-shaped opening, said rotation axle of said one of said first blocks being connected to a sixth said axle rod extending through said third square-shaped opening to complete a firth layer of said intellectual cube, and wherein assembly of said intellectual cube may be completed by simply stacking said first through seventh sub-units in order and securing said first block of the seventh sub-unit to said pivot to complete assembly.

2. An intellectual cube as claimed in claim 1, wherein all said blocks are made of an injection molded plastisol compound, and wherein said blocks are all hollow in order to prevent deformation and weight reduction of said plastisol compound during a cooling process of the plastic.

* * * * *